US008851644B2

(12) United States Patent
Shirono et al.

(10) Patent No.: US 8,851,644 B2
(45) Date of Patent: Oct. 7, 2014

(54) METHODS OF MANUFACTURING RECYCLED LIQUID CARTRIDGE AND LIQUID CARTRIDGE, AND LIQUID CARTRIDGE

(71) Applicants: Taichi Shirono, Nagoya (JP); Noritsugu Ito, Tokoname (JP); Mikio Hirano, Okazaki (JP)

(72) Inventors: Taichi Shirono, Nagoya (JP); Noritsugu Ito, Tokoname (JP); Mikio Hirano, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/783,121

(22) Filed: Mar. 1, 2013

(65) Prior Publication Data

US 2013/0175272 A1 Jul. 11, 2013

Related U.S. Application Data

(63) Continuation-in-part of application No. PCT/JP2011/067184, filed on Jul. 21, 2011.

(30) Foreign Application Priority Data

Sep. 2, 2010 (JP) ..... 2010-196340

(51) Int. Cl.

| | |
|---|---|
| ***B41J 2/175*** | (2006.01) |
| ***B65D 50/06*** | (2006.01) |
| ***B65B 1/04*** | (2006.01) |

(52) U.S. Cl.

CPC ..... *B65D 50/06* (2013.01); *B41J 2/17553* (2013.01); *B41J 2/17546* (2013.01); *B41J 2/17523* (2013.01); *B41J 2/17506* (2013.01); *B65B 1/04* (2013.01); *B41J 2/1753* (2013.01)

USPC ..... 347/86; 347/84; 347/85

(58) Field of Classification Search

USPC ..... 347/84, 85, 86, 87

See application file for complete search history.

(56) References Cited

U.S. PATENT DOCUMENTS 5,751,320 A 5/1998 Scheffelin et al.
6,170,937 B1 * 1/2001 Childers et al. ..... 347/85

(Continued)

FOREIGN PATENT DOCUMENTS

EP 1 241 010 A1 9/2002
EP 1384589 A1 1/2004

(Continued)

OTHER PUBLICATIONS

Japan Patent Office, International Search Report and Written Opinion for International Application No. PCT/JP2011/067184 (counterpart to above-captioned patent application), mailed Sep. 20, 2011.

(Continued)

*Primary Examiner* — Anh T. N. Vo

(74) *Attorney, Agent, or Firm* — Baker Botts L.L.P.

(57) ABSTRACT

The method includes: (a) preparing a liquid cartridge to be recycled and including a liquid storing unit, a liquid delivery path having an opening, a blocking member detachably mounted in the liquid delivery path to block the opening, and a valve configured to be switched between an open state and a closed state; (b) removing the blocking member from the liquid delivery path; (c) switching the valve from the closed state to the open state; (d) injecting liquid into the liquid storing unit through the opening with the blocking member removed in step (b) and the valve maintained in the open state achieved in step (c); (e) switching the valve from the open state to the closed state after performing step (d); and (f) assembling the blocking member or another blocking member different from the blocking member in the liquid delivery path to block the opening after performing step (e).

9 Claims, 14 Drawing Sheets

(56) References Cited

U.S. PATENT DOCUMENTS

| | | | | |
|---|---|---|---|---|
| 6,786,581 | B1 * | 9/2004 | Shinada et al. | 347/86 |
| 6,802,601 | B2 | 10/2004 | Suzuki et al. | |
| 6,942,327 | B2 | 9/2005 | Suzuki et al. | |
| 7,011,385 | B2 * | 3/2006 | Kitabatake et al. | 347/19 |
| 7,178,910 | B2 | 2/2007 | Suzuki et al. | |
| 7,490,928 | B2 | 2/2009 | Suzuki et al. | |
| 2004/0114003 | A1 | 6/2004 | Kitabatake et al. | |
| 2005/0243147 | A1 | 11/2005 | Qingguo et al. | |

FOREIGN PATENT DOCUMENTS

| | | | |
|---|---|---|---|
| JP | H07-089087 | A | 4/1995 |
| JP | 2003-011379 | A | 1/2003 |
| JP | 2003-305862 | A | 10/2003 |
| JP | 2004-123099 | A | 4/2004 |
| JP | 2005-199516 | A | 7/2005 |
| JP | 2006-062282 | A | 3/2006 |

OTHER PUBLICATIONS

The International Bureau of WIPO, International Preliminary Report on Patentability for International Patent Application No. PCT/JP2011/067184 (counterpart International patent application), recevied Mar. 22, 2013.

European Patent Office, Extended European Search Report for European Patent Application No. 11821475.8 (related to above-captioned patent application), mailed Jul. 15, 2014.

* cited by examiner

METHODS OF MANUFACTURING RECYCLED LIQUID CARTRIDGE AND LIQUID CARTRIDGE, AND LIQUID CARTRIDGE

CROSS REFERENCE TO RELATED APPLICATION

This application claims priority from Japanese Patent Application No. 2010-196340 filed Sep. 2, 2010. This application is also a continuation-in-part of International Application No. PCT/JP2011/067184 filed Jul. 21, 2011 in Japan Patent Office as a Receiving Office. The contents of these applications are incorporated herein by reference.

TECHNICAL FIELD

The present invention relates to a method of manufacturing a recycled liquid cartridge that stores a liquid such as ink, a method of manufacturing a liquid cartridge and the liquid cartridge.

BACKGROUND

Methods of recycling liquid cartridges are known in the art. According to one such method disclosed in Japanese Patent Application Publication No. 2006-62282, a used liquid cartridge is recycled by removing a supply port member from an opening in the liquid cartridge that communicates with the interior of a liquid bag, and subsequently injecting liquid into the liquid bag through the opening. After injecting the liquid, a new supply port member is mounted in the opening, thereby completing the recycling process.

In the above described liquid cartridge, the supply port member has a supply port in which a rubber material is press fitted. When mounting the liquid cartridge in a liquid-ejecting device (inkjet recording device, for example), a hollow needle disposed in the liquid-ejecting device penetrates the rubber material in the supply port. The liquid stored in the liquid bag is drawn out through the hollow needle and supplied to a recording head.

SUMMARY

According to the method of recycling a liquid cartridge disclosed in Japanese Patent Application Publication No. 2006-62282, the opening in the liquid cartridge is not closed up after injecting liquid into the liquid bag until a new supply port member is mounted in the opening. Accordingly, the liquid may leak from the liquid bag during this interval. In order to prevent such leakage, it is conceivable to inject liquid after mounting a new supply port member in the opening. However, in this case, a hollow needle disposed in a liquid-injecting device may penetrate and form a hole in the rubber material positioned in the supply port. When the liquid cartridge is subsequently mounted in the liquid-ejecting device, the hollow needle may penetrate and form another hole in the rubber material. Since these two penetration holes may be formed at different positions in the rubber material, the liquid may leak from the liquid bag into the liquid-ejecting device through the penetration hole formed by the hollow needle of the injector, after mounting the liquid cartridge in the liquid-ejecting device.

It is an object of the present invention to provide methods of manufacturing a liquid cartridge and a recycled liquid cartridge, which methods can restrain the leakage of liquid. It is another object of the present invention to provide a liquid cartridge manufactured according to this method.

In order to attain the above and other objects, the invention provides a method of manufacturing a recycled liquid cartridge. The method includes: (a) preparing a liquid cartridge to be recycled, the liquid cartridge including a liquid storing unit configured to store liquid therein, a liquid delivery path that is in fluid communication with the liquid storing unit and is configured to supply liquid externally from the liquid storing unit, the liquid delivery path having an opening, a blocking member detachably mounted in the liquid delivery path to block the opening, and a valve configured to be switched between an open state in which the liquid delivery path is opened and a closed state in which the liquid delivery path is closed, the valve being positioned between the opening and the liquid storing unit; (b) removing the blocking member from the liquid delivery path; (c) switching the valve from the closed state to the open state; (d) injecting liquid into the liquid storing unit through the opening with the valve maintained in the open state achieved in step (c); (e) switching the valve from the open state to the closed state after performing step (d); and (f) assembling the blocking member or another blocking member different from the blocking member in the liquid delivery path to block the opening after performing step (e).

According to another aspect, the present invention provides a method of manufacturing a liquid cartridge. The method includes: (a) preparing a semimanufactured liquid cartridge, the semimanufactured liquid cartridge including a liquid storing unit configured to store liquid therein, a liquid delivery path that is in fluid communication with the liquid storing unit and is configured to supply liquid externally from the liquid storing unit, the liquid delivery path having an opening, and a valve configured to be switched between an open state in which the liquid delivery path is opened and a closed state in which the liquid delivery path is closed, the valve being positioned between the opening and the liquid storing unit; (b) switching the valve from the closed state to the open state; (c) injecting liquid into the liquid storing unit through the opening with the valve maintained in the open state achieved in step (b); (d) switching the valve from the open state to the closed state after performing step (c); and (e) assembling a blocking member in the liquid delivery path to block the opening after performing step (d) in such a manner that the blocking member is detachable from the liquid delivery path.

According to another aspect, the present invention provides a liquid cartridge including: a liquid storing unit, a liquid delivery path, a blocking member, and a valve. The liquid storing unit is configured to store liquid therein. The liquid delivery path is in fluid communication with the liquid storing unit and is configured to supply liquid externally from the liquid storing unit. The liquid delivery path has an opening. The blocking member is detachably mounted in the liquid delivery path to block the opening. The blocking member includes a resilient member that is detachably mountable in the liquid delivery path in a compressed state. The valve is configured to be capable of being switched between an open state in which the liquid delivery path is opened and a closed state in which the liquid delivery path is closed. The valve is positioned between the opening and the liquid storing unit. The liquid cartridge is detachably mountable on a liquid ejection device including a liquid ejecting part that ejects the liquid supplied from the liquid cartridge and a hollow member that is configured to be inserted through the blocking member for supplying the liquid from the liquid cartridge to the liquid ejecting part. The blocking member includes a rupturable part that is configured to be ruptured by the hollow member when the hollow member is inserted through the blocking member.

BRIEF DESCRIPTION OF THE DRAWINGS

In the drawings:

FIG. 5(*b*) is a partial cross-sectional view of the ink cartridge according to the first embodiment when the valve is opened;

FIG. 11(*b*) is a plan view showing a stopper when viewed from a XIB direction shown in FIG. 11(*a*);

FIG. 12(*c*) is a graph showing a current value measured by a ammeter during the mounting process;

DETAILED DESCRIPTION

Next, embodiments of the present invention will be described while referring to the accompanying drawings.

First, the general structure of an inkjet printer 1 will be described with reference to FIG. 1. The inkjet printer 1 employs ink cartridges according to a first embodiment of the present invention. The ink cartridges are detachably mounted in the inkjet printer 1.

Figure 1:
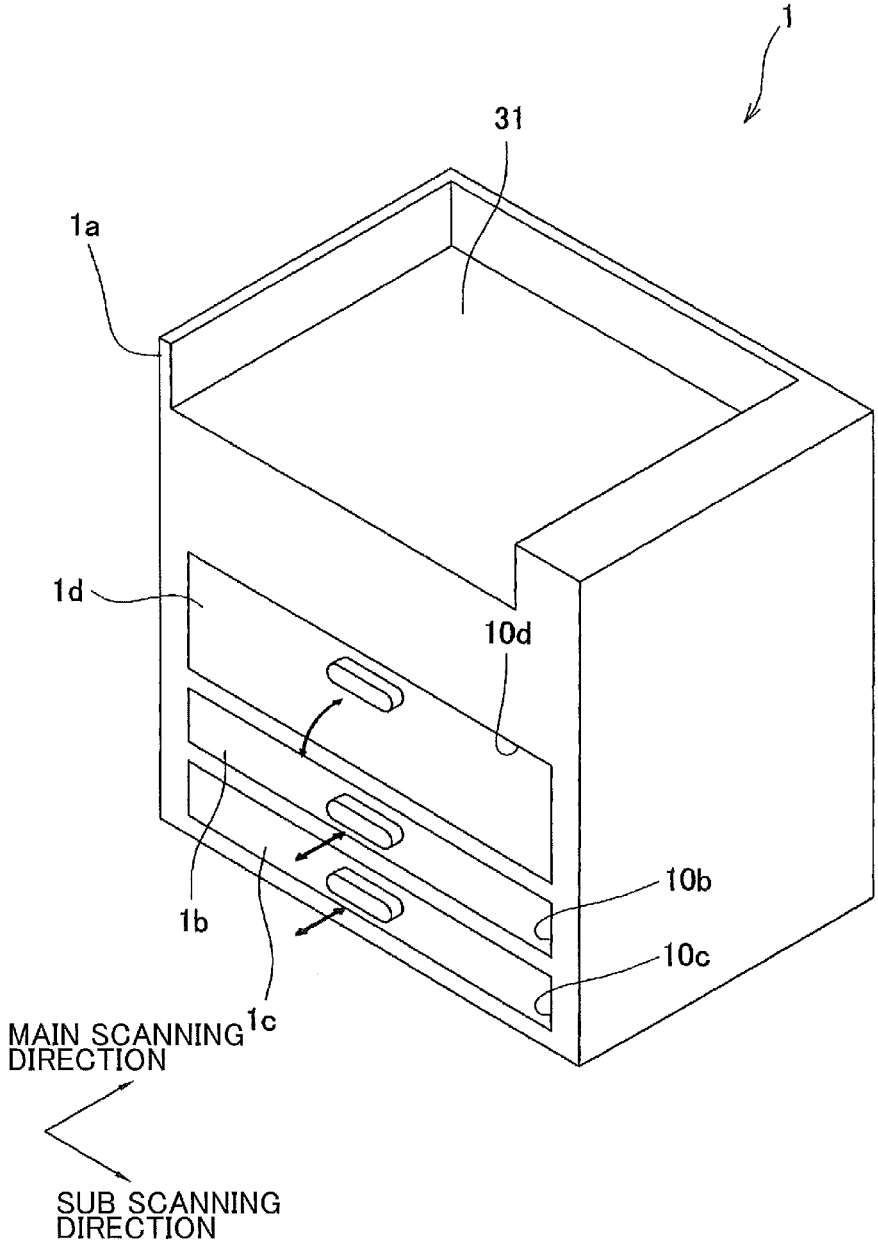
FIG. 1 is a perspective view showing an external appearance of an inkjet printer according to a first embodiment of the present invention.

As shown in FIG. 1, the inkjet printer 1 has a casing 1*a* formed in the shape of a rectangular parallelepiped. A paper discharge unit 31 is provided on a top plate constituting the casing 1*a*. Three openings 10*d*, 10*b*, and 10*c* are formed in order from top to bottom in the front surface of the casing 1*a* (the surface on the near left side in FIG. 1). The opening 10*b* is provided for inserting a sheet-feeding unit 1*b* into the casing 1*a*, while the opening 10*c* is formed for inserting an ink unit 1*c* into the casing 1*a*. A door 1*d* is fitted into the opening 10*d* and is capable of pivoting about a horizontal axis passing through its lower edge. The door 1*d* is provided in the casing 1*a* at a position confronting a conveying unit 21 described later (see FIG. 2) in a main scanning direction of the inkjet printer 1 (a direction orthogonal to the front surface of the casing 1*a*).

Next, the internal structure of the inkjet printer 1 will be described with reference to FIG. 2.

Figure 2:
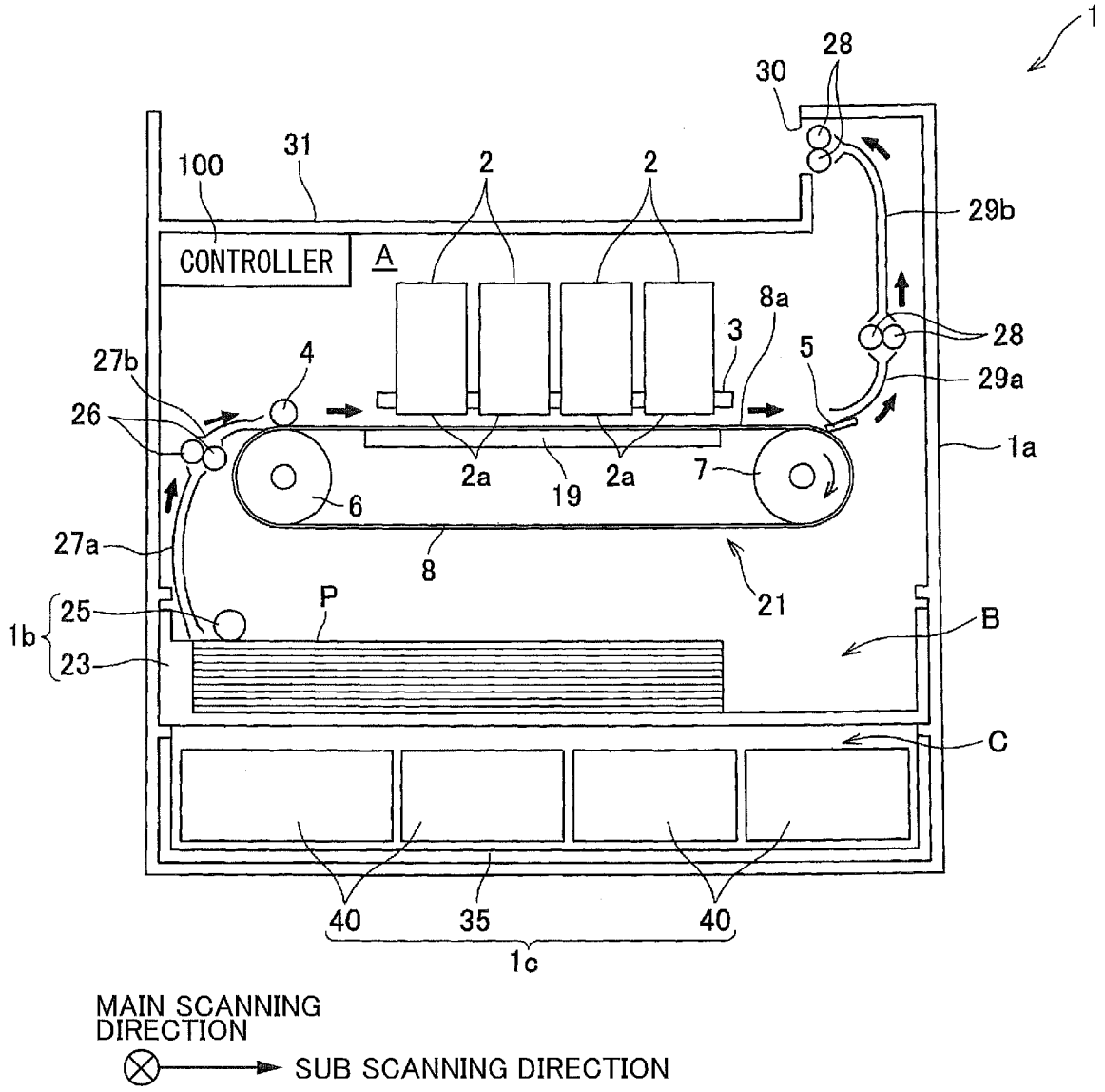
FIG. 2 is a side cross-sectional view showing an internal structure of the inkjet printer in FIG. 1.

As shown in FIG. 2, the interior of the casing 1*a* is partitioned into three spaces A, B, and C in order from top to bottom. Within the space A are disposed four inkjet heads 2 that eject ink droplets in the respective colors magenta, cyan, yellow, and black; the conveying unit 21 that conveys sheets of a paper P; and a controller 100 that controls operations of various components in the inkjet printer 1. The sheet-feeding unit 1*b* is disposed in the space B, and the ink unit 1*c* is disposed in the space C. As indicated by the bold arrows in FIG. 2, a paper-conveying path is also formed in the inkjet printer 1 for guiding sheets of paper P conveyed from the sheet-feeding unit 1*b* to the paper discharge unit 31.

In addition to a central processing unit (CPU), the controller 100 includes a read-only memory (ROM), a random access memory (RAM; including nonvolatile RAM), and an interface. The ROM stores programs executed by the CPU, various fixed data, and the like. The RAM temporarily stores data (image data and the like) required by the CPU when executing programs. Through its interface, the controller 100 exchanges data with a sensor unit 70 of an ink cartridge 40 described later and exchanges data with external devices such as a PC connected to the inkjet printer 1.

The sheet-feeding unit 1*b* includes a paper tray 23, and a feeding roller 25. The paper tray 23 can be mounted in and removed from the casing 1*a* along the main scanning direction. The paper tray 23 is box-shaped with an open top and can accommodate sheets of paper P in a variety of sizes. The feeding roller 25 is driven to rotate by a feeding motor 125 (see FIG. 7) under control of the controller 100 in order to feed the topmost sheet of paper P in the paper tray 23. A sheet fed by the feeding roller 25 is guided along guides 27*a* and 27*b*, and a pair of conveying rollers 26 grip and convey the sheet to the conveying unit 21.

The conveying unit 21 includes two belt rollers 6 and 7 and an endless conveying belt 8 looped around the belt rollers 6 and 7 and stretched therebetween. The belt roller 7 is the drive roller. A conveying motor 127 (see FIG. 7) coupled with a shaft of the belt roller 7 drives the belt roller 7 to rotate clockwise in FIG. 2 under control of the controller 100. The belt roller 6 is a follow roller that rotates clockwise in FIG. 2 when the conveying belt 8 is circulated by the rotating belt roller 7.

A platen 19 having a rectangular parallelepiped shape is disposed within the loop of the conveying belt 8 at a position opposite the four inkjet heads 2. The top surface of the platen 19 contacts the inner surface of the conveying belt 8 on the upper portion of the loop and supports this upper loop portion from the inner surface of the conveying belt 8. Accordingly, the outer surface 8*a* on the upper loop portion of the conveying belt 8 is maintained parallel and opposite the ejection surfaces 2*a*, with a slight gap formed between the ejection surfaces 2*a* and the outer surface 8*a*. The bottom surfaces 2*a* of the inkjet heads 2 are ejection surfaces in which are formed a plurality of ejection holes for ejecting ink droplets.

The outer surface 8*a* of the conveying belt 8 is coated with mildly adhesive silicon. When a sheet of paper P is conveyed from the sheet-feeding unit 1*b* onto the conveying unit 21, a nip roller 4 disposed above the belt roller 6 holds the sheet against the outer surface 8*a* of the conveying belt 8. Thereafter, the conveying belt 8 conveys the sheet in a sub scanning direction indicated by the bold arrows, while the sheet is held on the outer surface 8*a* by its adhesive coating.

The sub scanning direction in this embodiment is parallel to the direction that the conveying unit 21 conveys the paper P. The main scanning direction follows a horizontal plane orthogonal to the sub scanning direction.

As the sheet of paper P held on the outer surface 8*a* of the conveying belt 8 passes directly beneath the four inkjet heads 2, the controller 100 sequentially controls the inkjet heads 2 to eject ink droplets in their respective colors through their bottom surfaces 2*a* onto the top surface of the paper P, thereby forming a desired color image on the paper P. A separating plate 5 disposed above the belt roller 7 separates the sheet from the outer surface 8*a* of the conveying belt 8 after the sheet has passed beneath the inkjet heads 2. Guides 29*a* and 29*b* disposed downstream of the separating plate 5 guide the sheet upward toward an opening 30 formed in the top of the casing 1*a*, while two pairs of conveying rollers 28 grip and convey the sheet toward and through the opening 30 and discharge the sheet into the paper discharge unit 31. A feeding motor 128 (see FIG. 7) controlled by the controller 100 drives one of the conveying rollers 28 in each pair to rotate.

Each of the inkjet heads 2 is a line-type print head elongated in the main scanning direction (the direction orthogonal to the plane of the paper in FIG. 2). Externally, the inkjet head 2 is shaped substantially like a rectangular parallelepiped. The four inkjet heads 2 are arranged at a prescribed pitch in the sub scanning direction and are supported in the casing 1*a* on a frame 3. A joint is provided on the top surface of each inkjet head 2 for attaching a flexible tube. A plurality of ejection holes is formed in the bottom surface 2*a* of each inkjet head 2. Ink cartridges 40 provided one for each of the inkjet heads 2 supply ink to the corresponding inkjet heads 2 through the flexible tubes and joints. An ink channel is formed in each inkjet head 2 for conveying the ink supplied from the ink cartridge 40 to the ejection holes.

The ink unit 1*c* includes a cartridge tray 35, and four of the ink cartridges 40 arranged in a row within the cartridge tray 35. The leftmost ink cartridge 40 shown in FIG. 2 stores black ink. This leftmost ink cartridge 40 has a larger dimension in the sub scanning direction and, hence, a greater ink capacity than the other three ink cartridges 40. The remaining ink cartridges 40 have an identical dimension in the sub scanning direction and an identical ink capacity among one another. These three ink cartridges 40 respectively store ink in the colors magenta, cyan, and yellow. Ink stored in each of the ink cartridges 40 is supplied to a corresponding inkjet head 2 via a flexible tube and joint.

With the ink cartridges 40 arranged in the cartridge tray 35, the cartridge tray 35 can be mounted in and removed from the casing 1*a* in the sub scanning direction. Accordingly, a user of the inkjet printer 1 can selectively replace the four ink cartridges 40 in the cartridge tray 35 after removing the cartridge tray 35 from the casing 1*a*.

Figure 3:
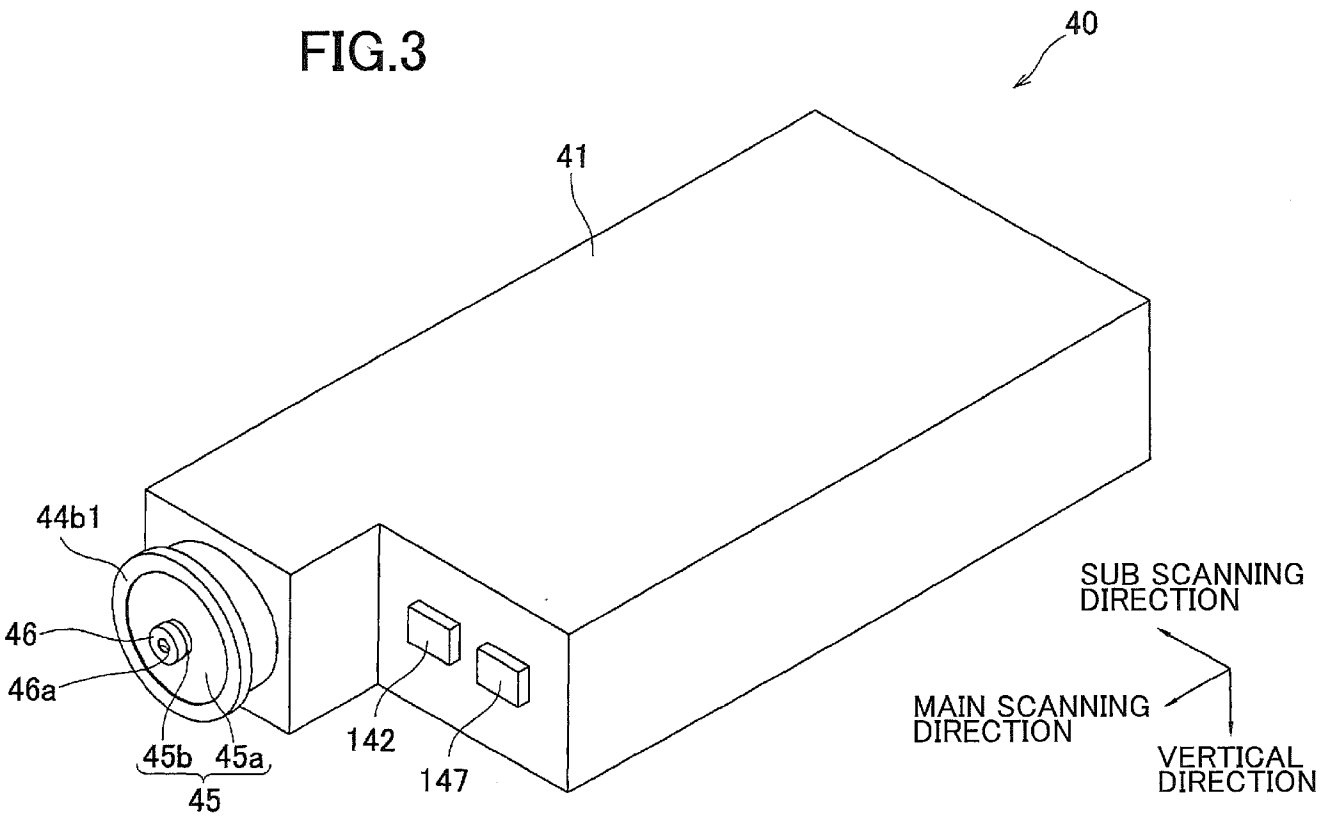
FIG. 3 is a perspective view of an ink cartridge according to the first embodiment of the present invention.

Next, the structure of the ink cartridges 40 will be described with reference to FIGS. 3 through 5. The four ink cartridges 40 arranged in the cartridge tray 35 have the same structure, except that the ink cartridge 40 storing black ink has a larger dimension in the sub scanning direction and a greater ink storage capacity than the ink cartridges 40 for the other colors, as described above.

Each ink cartridge 40 includes a case 41 having a rectangular parallelepiped shape (see FIGS. 3 and 4), a reservoir 42 provided inside the case 41 (see FIG. 4), and an outlet tube 43. Inner walls of the outlet tube 43 define an outlet path 43*a* (see FIG. 5) through which ink stored in the reservoir 42 is discharged (supplied to the inkjet head 2). The ink cartridge 40 also includes a stopper 50 and a valve 60 disposed in the outlet path 43*a* (see FIG. 5), a sensor 140 for detecting the valve 60, a memory unit 141, and a contact 142 and a power input unit 147 (see FIGS. 3 and 4).

Figure 4:
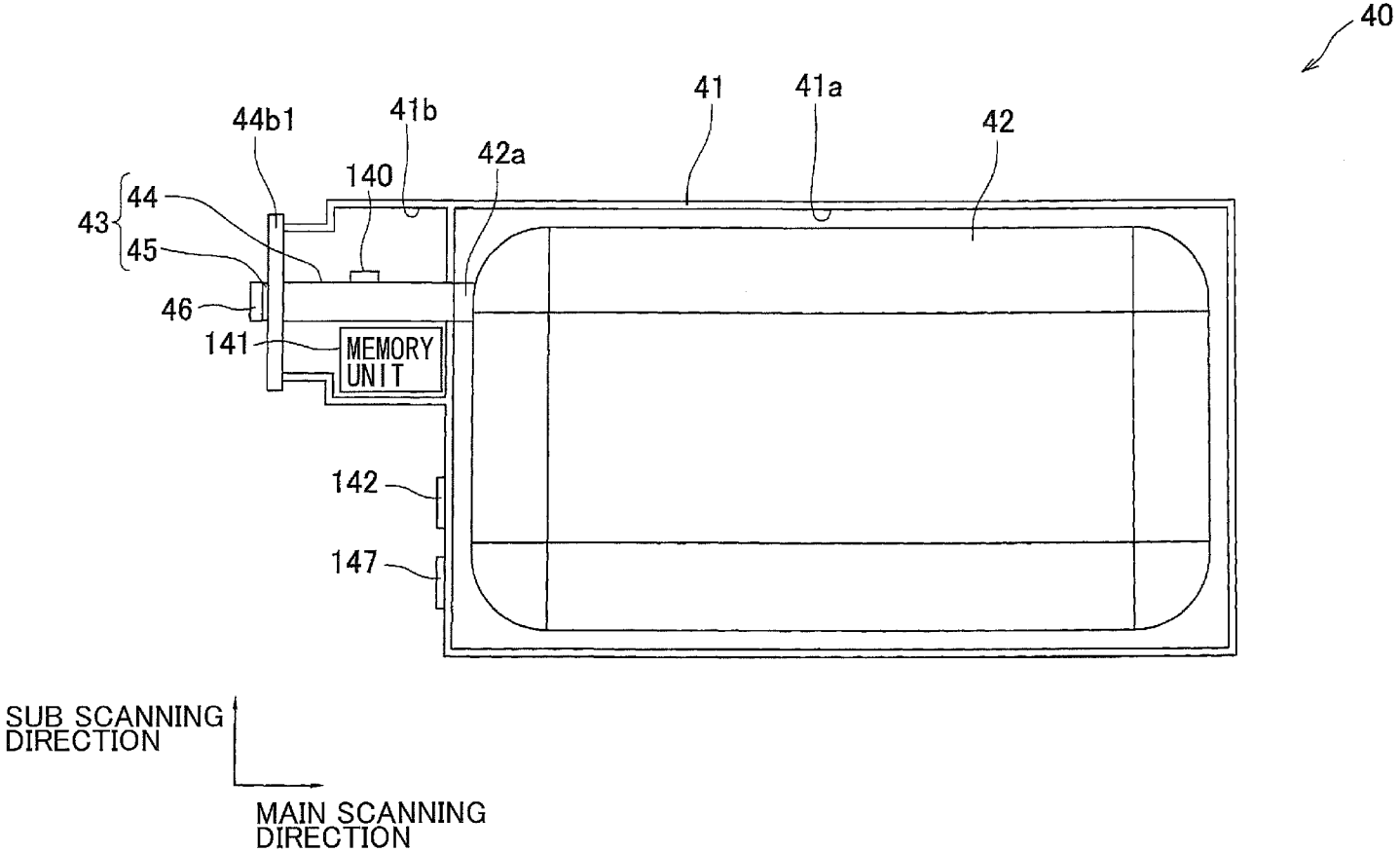
FIG. 4 is a schematic diagram showing the internal structure of the ink cartridge in FIG. 3.

As shown in FIG. 4, the interior of the case 41 is partitioned into two chambers 41*a* and 41*b*. The reservoir 42 is provided in the chamber 41*a* on the right of the chamber 41*b* in FIG. 4, while the outlet tube 43 is provided in the other chamber 41*b*.

The reservoir 42 is a bag-like member that serves to store ink. A cylindrical joint 42*a* is attached to an opening formed in the reservoir 42. The reservoir 42 is in communication with the outlet path 43*a* via the cylindrical joint 42*a*.

The outlet tube 43 includes a tube 44 and a cover 45 that are coupled together. The cover 45 has a disc-shaped part 45*a* with a circular hole formed in the center thereof, and a cylindrical protruding part 45*b* protruding in the main scanning direction from the circumferential edge of the opening formed in the disc-shaped part 45*a*. In this embodiment, the tube 44 is constructed of a transparent resin material. By forming the tube 44 of a transparent resin material, the sensor 140 can detect a second member 66, as will be described later. Further, the tube 44 has a cylindrical main part 44*a* elongated in the main scanning direction, and a disc-shaped flange 44*b* having a circular opening in the center thereof. The cylindrical joint 42*a* is fitted into one end of the main part 44*a*, and the disc-shaped part 45*a* of the cover 45 is fitted into the flange 44*b* at the other end of the main part 44*a*.

The flange 44*b* extends outward from the peripheral edge of the opening formed in the other end of the main part 44*a*. An annular recess is formed in the flange 44*b* around the peripheral edge of the opening therein. An O-ring 43*x* is accommodated in this annular recess. The flange 44*b* contacts the opposing surface of the disc-shaped part 45*a* from the recess to the outer peripheral edge of the disc-shaped part 45*a*. A protrusion 44*b*1 is formed along the entire periphery of the flange 44*b* and protrudes in the main scanning direction. The disc-shaped part 45*a* is fitted into the recessed part formed by the flange 44*b* and the protrusion 44*b*1. The disc-shaped part 45*a* and the flange 44*b* hold the O-ring 43*x* in a state of elastic deformation. The protrusion 44*b*1 and the outer edges of the flange 44*b* and disc-shaped part 45*a* are joined along the entire circumference through swaged joint. The O-ring 43*x* is formed of a rubber or other elastic material and functions to prevent ink from leaking through the joined parts of the tube 44 and cover 45.

Figure 5A:
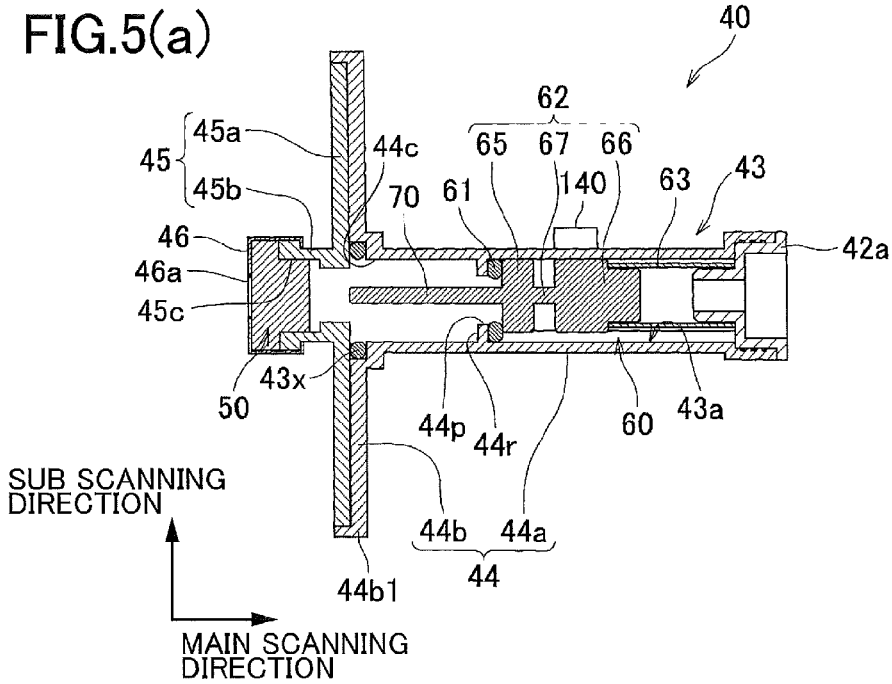
FIG. 5(*a*) is a partial cross-sectional view of the ink cartridge according to the first embodiment when a valve is closed.
Figure 5B:
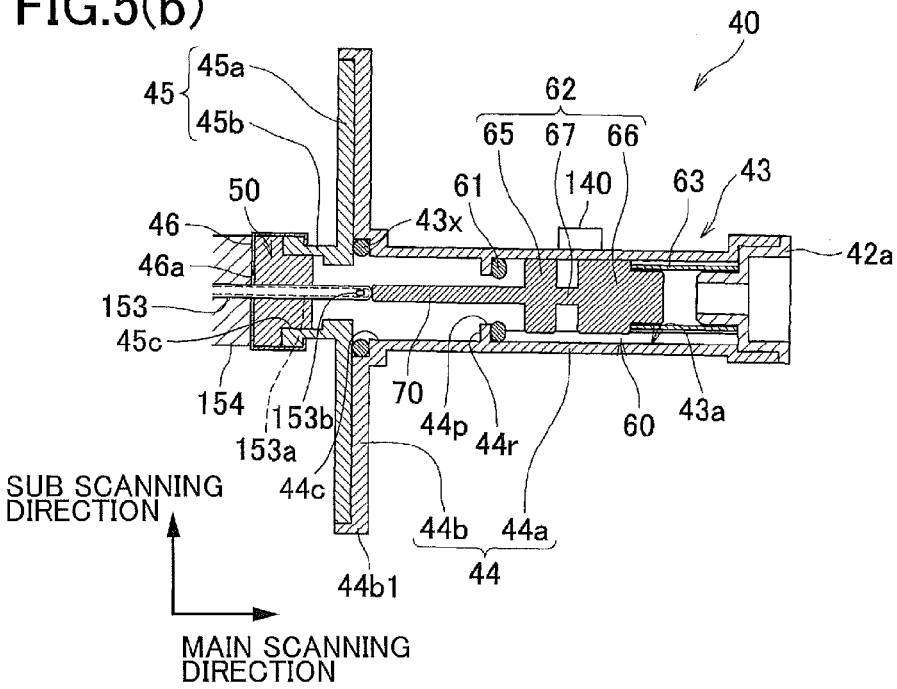

As shown in FIG. 5, the outlet path 43*a* is formed inside the tube 44 and cover 45. That is, the outlet path 43*a* is formed of two continuous spaces including the space within the tube 44 and the space within the cover 45.

As shown in FIG. 5, the stopper 50 is substantially columnar-shaped and is disposed in the distal end of the protruding part 45*b* (the end opposite the disc-shaped part 45*a*) in a compressed state for blocking an opening 45*c* in the protruding part 45*b*. The stopper 50 is formed of a rubber or other resilient material and includes a portion disposed inside the protruding part 45*b* and a portion disposed outside the protruding part 45*b*. Together with the cover 45 and a cap 46 described later, the stopper 50 is detachably mounted on the protruding part 45*b*.

A cap 46 is fitted over the outside of the distal end of the protruding part 45*b* and the stopper 50. By covering the stopper 50 when the stopper 50 is fitted into the distal end of the protruding part 45*b*, the cap 46 prevents the stopper 50 from coming out of the protruding part 45*b*. A hole 46*a* is formed in the center of the cap 46, exposing the endface of the stopper 50. The cover 45, cap 46, and stopper 50 are served as a stopper unit described later.

As shown in FIG. 5, the valve 60 is provided inside the tube 44 and includes an O-ring 61, a valve body 62, and a coil spring 63.

The valve body 62 includes a columnar-shaped first member 65, a columnar-shaped second member 66, and a rod-like coupling member 67 having a smaller diameter than the first and second members 65 and 66 and serving to join the first and second members 65 and 66. A rod-like pressing member 70 is provided on the first member 65. The pressing member 70 extends in the main scanning direction from a center region on the surface of the first member 65 opposite the second member 66 and is inserted through an opening 44*p* defined by a distal edge of a rib 44*r*. The diameter of the pressing member 70 is smaller than the diameter of the opening 44*p* and substantially the same as the diameter of the coupling member 67. The rib 44*r* protrudes inward from the inner peripheral surface of the tube 44 in substantially the longitudinal center of the tube 44 in the main scanning direction.

The O-ring 61 is formed of a rubber or other elastic material and is fixed to the rear surface (the surface opposite the stopper 50) of the rib 44*r*. A base end of the coil spring 63 is fixed to the cylindrical joint 42*a*, while a distal end of the coil spring 63 contacts the valve body 62. The coil spring 63 constantly urges the valve body 62 toward the O-ring 61. When the valve 60 is in a closed state for closing the outlet path 43*a*, as shown in FIG. 5(*a*), the first member 65 contacts the O-ring 61 and seals the opening 44*p*. In this state, the valve 60 interrupts communication in the outlet path 43*a* between the space from the end of the tube 44 opposite the stopper 50 to the O-ring 61 and the space from the O-ring 61 to the stopper 50, and interrupts external communication with the reservoir 42 via the outlet path 43*a*. At this time, the O-ring 61 is elastically deformed by the urging force of the coil spring 63.

The sensor 140 is a reflective-type photosensor having a light-emitting unit and a light-receiving unit. The sensor 140 can detect the presence of an object without contact. The light-emitting unit of the sensor 140 emits light at an intensity based on a signal (and more specifically an input value specified by the signal; the input value being a value of electric current in this embodiment) inputted from the controller 100 via the contact 142. The sensor 140 outputs a signal specifying the intensity of light received by the light-receiving unit to the controller 100 via the contact 142.

The sensor 140 is disposed at a position so that the entire area of the light-emitting unit and light-receiving unit confront the second member 66 when the valve 60 is in the closed state shown in FIG. 5(*a*) and so that substantially half the area of these units does not oppose the second member 66 when the valve 60 is in the open state shown in FIG. 5(*b*) for opening the outlet path 43*a*. The peripheral surface of the second member 66 is formed of a mirror surface capable of reflecting light. The sensor 140 outputs a signal to the controller 100 specifying a high current value when the valve 60 is in the closed state, because nearly all of the light emitted from the light-emitting unit is reflected off the peripheral surface of the second member 66 and received by the light-receiving unit. However, the sensor 140 outputs a signal to the controller 100 specifying a low current value when the valve 60 is in the open state, because approximately half of the light emitted from the light-emitting unit is reflected off the peripheral surface of the second member 66 and received by the light-receiving unit. Therefore, the sensor 140 outputs a larger value (a value specified by the signal outputted from the sensor 140; an electric current value in this embodiment) when the valve 60 is in the closed state than when the valve 60 is in the open state.

The memory unit 141 is configured of EEPROM and serves to store data indicating whether a hollow needle 153 described later has been inserted through the stopper 50. In this embodiment, this data is a flag that is set to ON when the hollow needle 153 has not been inserted through the stopper 50 and OFF when the hollow needle 153 has been inserted through the stopper 50.

In this embodiment, the ON/OFF state of the flag is set not by directly detecting whether the hollow needle 153 is inserted through the stopper 50, but based on results of detecting whether the valve 60 is open or closed, as will be described later. (As shown in S3 and S4 of FIG. 8, the flag is set to OFF when the valve 60 switches from the closed state to the open state.)

Figure 6A:
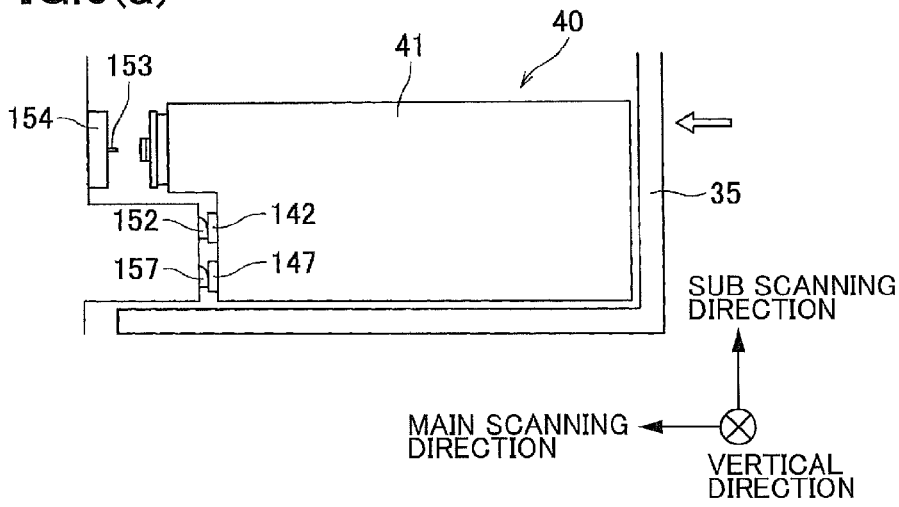
FIGS. 6(*a*) and 6(*b*) are schematic diagrams showing the state how the ink cartridge is mounted in the printer, wherein FIG. 6(*a*) shows the state that a hollow needle is separated from the ink cartridge, and FIG. 6(*b*) shows the state that the hollow needle penetrates a stopper of the ink cartridge.
Figure 6B:
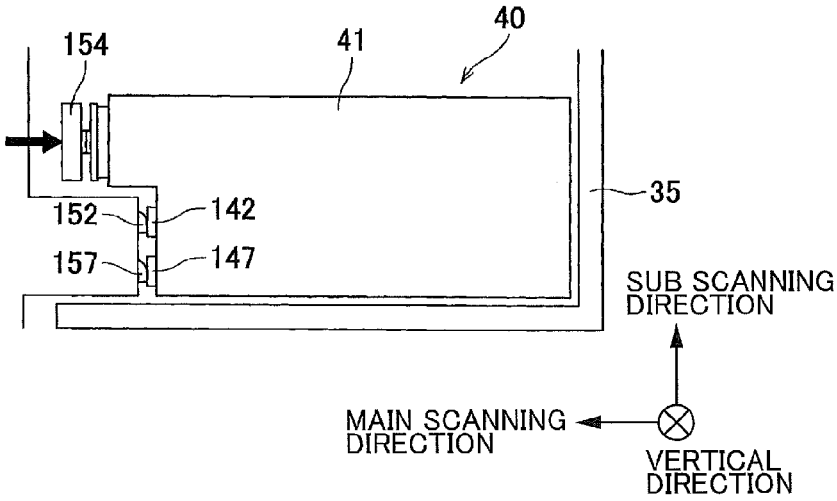
Figure 7:
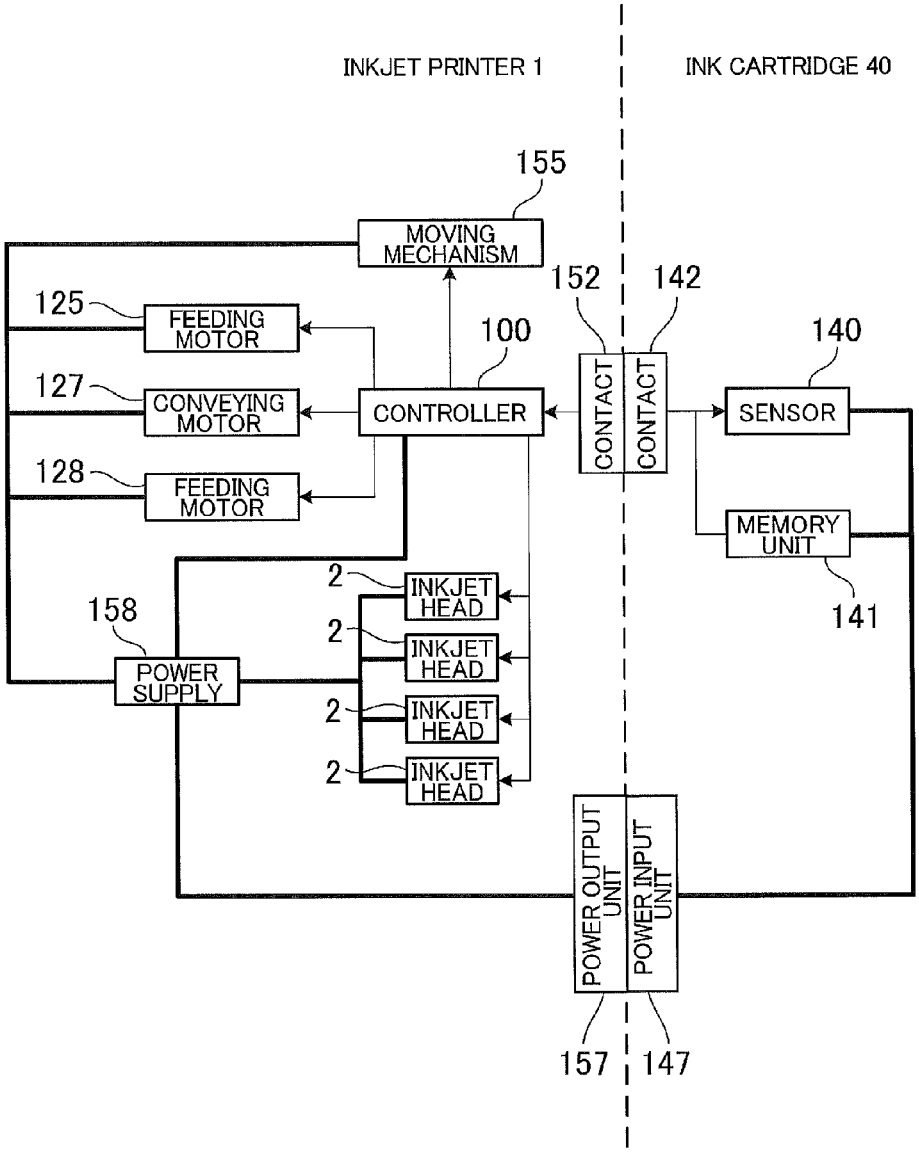
FIG. 7 is a block diagram showing the electrical structure of the inkjet printer and ink cartridge according to the first embodiment.

As shown in FIG. 6, the inkjet printer 1 is also provided with a contact 152, a power output unit 157, and a support body 154 for each ink cartridge 40, as well as a moving mechanism 155 and a power supply 158 (see FIG. 7).

The contact 152 is disposed on a wall surface of the casing 1*a* at a position opposing the contact 142 on the corresponding ink cartridge 40 when the ink cartridge 40 is mounted in the inkjet printer 1. The contact 152 functions as an interface of the controller 100 for communicating with the corresponding ink cartridge 40 when electrically connected to the contact 142 on the ink cartridge 40.

The power output unit 157 is exposed in a wall surface of the casing 1*a* at a position opposing the power input unit 147 of the corresponding ink cartridge 40 when the ink cartridge 40 is mounted in the inkjet printer 1. The power output unit 157 is electrically connected to the power supply 158 and functions to supply power from the power supply 158 to the sensor 140 of the ink cartridge 40 when electrically connected to the power input unit 147.

The support body 154 is disposed in a wall surface of the casing 1*a* at a position opposing the cap 46 of the corresponding ink cartridge 40 when the ink cartridge 40 is mounted in the inkjet printer 1. The support body 154 functions to support a hollow needle 153 and can be moved relative to the casing 1*a* in the main scanning direction for inserting the hollow needle 153 into and extracting the hollow needle 153 from the ink cartridge 40.

The hollow needle 153 is fixed to the support body 154 and is in communication with the flexible tube attached to the joint of the corresponding inkjet head 2. As shown in FIG. 5(*b*), the hollow needle 153 extends in the main scanning direction. A channel 153*a* is formed inside the hollow needle 153 along its longitudinal dimension and is in fluid communication with the flexible tube attached to the joint of the corresponding inkjet head 2. A hole 153*b* is formed near the distal end of the hollow needle 153 for providing external communication with the channel 153*a*.

The moving mechanism 155 is disposed in the casing 1*a* and functions to move the support body 154 and the hollow needle 153 fixed to the support body 154 in the main scanning direction.

The power supply 158 is disposed in the casing 1*a* and provides power to various components of the inkjet printer 1 and to the sensor unit 70 in each ink cartridge 40.

Next, operations for mounting the ink cartridges 40 in the inkjet printer 1 will be described with reference to FIGS. 5 through 8. In FIG. 7 the bold lines indicate power supply lines, while the fine lines indicate signal lines.

Before an ink cartridge 40 is mounted in the inkjet printer 1, the valve 60 is maintained in the closed state shown in FIG. 5(*a*). At this stage, the hollow needle 153 has not yet been inserted into the ink cartridge 40, the contact 142 has not yet been electrically connected to the contact 152, and the power input unit 147 has not yet been electrically connected to the power output unit 157. Hence, at this stage, the ink cartridge 40 and the inkjet printer 1 cannot exchange signals, and power is not being supplied to the sensor 140 and the memory unit 141.

To mount a cartridge in the inkjet printer 1, the user of the inkjet printer 1 places the ink cartridge 40 in the cartridge tray 35 (see FIG. 2) and subsequently inserts the cartridge tray 35 into the space C of the casing 1*a* by moving the cartridge tray 35 in the main scanning direction indicated by the white arrow in FIG. 6(*a*). Initially, this operation causes the contact 142 of the ink cartridge 40 to make contact with the contact 152 on the inkjet printer 1 side, as shown in FIG. 6(*a*), forming an electrical connection between the ink cartridge 40 and inkjet printer 1. Accordingly, the ink cartridge 40 and the inkjet printer 1 can now exchange signals.

At the same time the contacts 142 and 152 come into contact, the power input unit 147 of the ink cartridge 40 contacts the power output unit 157 of the inkjet printer 1, as shown in FIG. 6(*a*). This contact forms an electrical connection that allows the power supply 158 in the inkjet printer 1 (see FIG. 7) to supply power to the sensor unit 70 via the power output unit 157 and power input unit 147.

At this stage, the ink cartridge 40 remains separated from the hollow needle 153. Therefore, the reservoir 42 is not in communication with the ink channel formed in the corresponding inkjet head 2.

Figure 8:
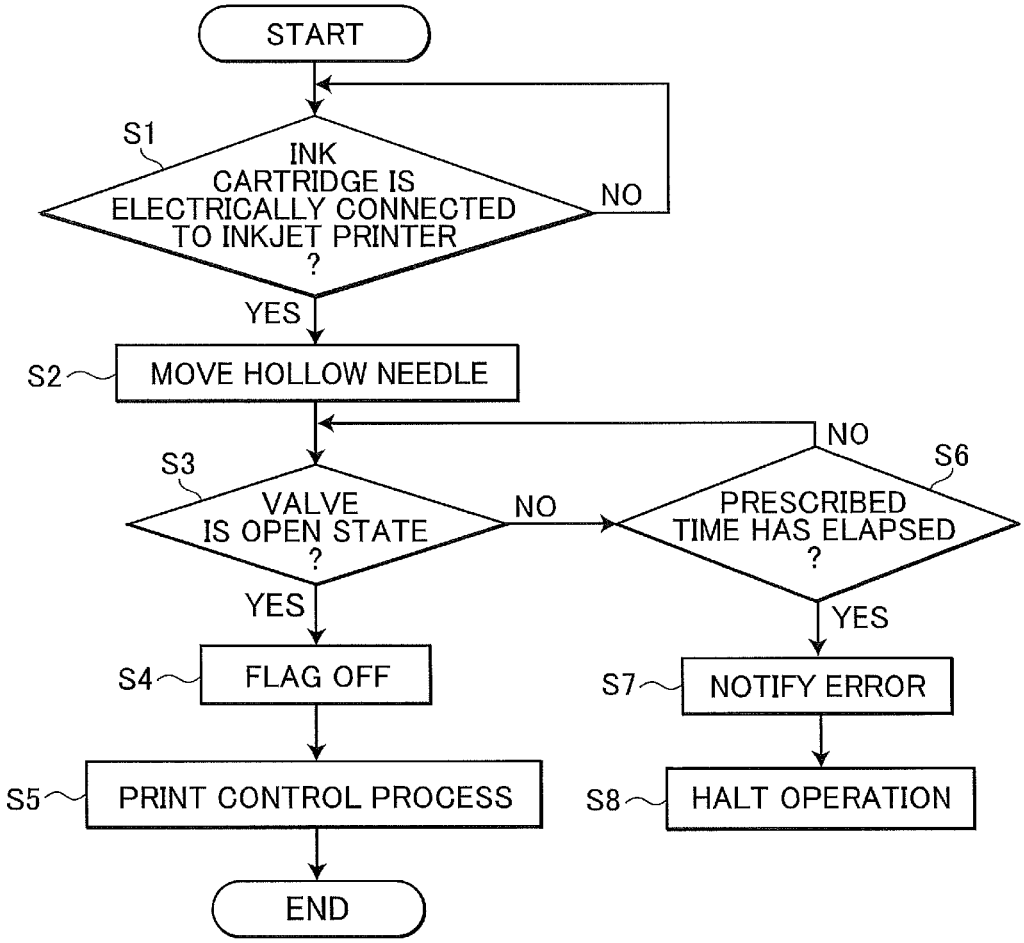
FIG. 8 is a flowchart illustrating steps in a control process performed by a controller in the inkjet printer according to the first embodiment when the ink cartridge is mounted in the inkjet printer.

FIG. 8 illustrates steps in a control process performed by the controller 100 when an ink cartridge 40 is mounted in the inkjet printer 1. In S1 of FIG. 8, the controller 100 determines whether an ink cartridge 40 has been electrically connected to the inkjet printer 1. Upon detecting an ink cartridge 40 being electrically connected to the inkjet printer 1 (S1: YES), in S2 the controller 100 controls the moving mechanism 155 (see FIG. 7) to begin moving the support body 154 and the hollow needle 153 supported by the support body 154 in the main scanning direction indicated by the black arrow in FIG. 6(*b*). After initiating the operation to move the hollow needle 153 in S2, in S3 the controller 100 determines whether the valve 60 has switched to its open state based on the value outputted from the sensor 140 and the like.

As the moving mechanism 155 begins moving the hollow needle 153 in S2, as illustrated in FIG. 5(*b*), the hollow needle 153 first passes through the hole 46*a* formed in the cap 46 and penetrates the approximate center region of the stopper 50 in the main scanning direction. When the hollow needle 153 is inserted through the stopper 50 until the hole 153*b* on the distal end thereof is positioned inside the outlet path 43*a*, the channel 153*a* formed in the hollow needle 153 is in communication with the outlet path 43*a* via the hole 153*b*. Although a penetration hole is formed in the stopper 50 by the hollow needle 153 through this operation, the elasticity of the stopper 50 allows the region of the stopper 50 surrounding the penetration hole to form a tight seal with the outer surface of the hollow needle 153, thereby preventing ink from leaking out through the penetration hole between the stopper 50 and hollow needle 153.

As the moving mechanism 155 continues to move the hollow needle 153, the distal end of the hollow needle 153 contacts the valve body 62 and continues inward into the outlet path 43*a*, pushing the pressing member 70 also inward into the outlet path 43*a*. The pressing member 70 and the valve body 62 move and separate from the O-ring 61 (see FIG. 5(*b*)). At this time, the valve 60 shifts from the closed state to the open state.

When the valve 60 is in the open state, the space in the outlet path 43*a* from the end of the tube 44 opposite the stopper 50 to the O-ring 61 is in communication with the space from the O-ring 61 to the stopper 50, allowing external communication with the reservoir 42 through the outlet path 43*a*. In other words, when the hollow needle 153 is inserted through the stopper 50 until the valve 60 is in the open state shown in FIG. 5(*b*), the reservoir 42 is in communication with the ink channel formed in the inkjet head 2 through the outlet path 43*a*, channel 153*a*, and the like.

When removing or replacing an ink cartridge 40, the user of the inkjet printer 1 first removes the cartridge tray 35 from the casing 1*a*. Through this operation, all four ink cartridges 40 are simultaneously separated from their respective support body 154, contact 152, and power output unit 157, thereby interrupting the electrical connections between the contact 142 and contact 152 and between the power input unit 147 and power output unit 157 for each ink cartridge 40; disabling the ability of each ink cartridge 40 to exchange signals with the inkjet printer 1; and interrupting the supply of power to the sensor 140 and the memory unit 141 in each ink cartridge 40. In addition, as the hollow needle 153 moves leftward in FIG. 5(*b*) relative to the ink cartridge 40, the urging force of the coil spring 63 moves the pressing member 70 and the valve body 62 leftward in FIG. 5(*b*). Accordingly, the first member 65 of the valve body 62 contacts the O-ring 61, switching the valve 60 from the open state to the closed state. After the hollow needle 153 is extracted from the stopper 50, the portion of the stopper 50 surrounding the penetration hole springs back to its original state due to the elasticity of the stopper 50, reducing the hole sufficiently to prevent ink leakage.

Next, the control process executed by the controller 100 to control the components of the inkjet printer 1 when an ink cartridge 40 is mounted in the inkjet printer 1 will be described in greater detail with reference to FIG. 8.

When the controller 100 determines through the process of S1-S2 described above that the valve 60 has switched to the open state (S3: YES), in S4 the controller 100 sets the flag in the memory unit 141 to OFF (or leaves the flag unchanged if already set to OFF). After setting the flag to OFF in S4, in S5 the controller 100 begins a print control process, and subsequently ends the current routine. In the print control process of S5, the controller 100 performs processes required when print commands are received from external devices, such as control processes for driving the feeding motor 125, conveying motor 127, and feeding motor 128 (see FIG. 7), as well as the inkjet heads 2 and the like.

However, while the controller 100 determines in S3 that the valve 60 has not shifted to the open state (S3: NO), the controller 100 continually repeats the determination in S3 while also determining in S6 whether a prescribed time has elapsed after the moving mechanism 155 begins moving the hollow needle 153. If the prescribed time elapses before the valve 60 is shifted to the open state (S6: YES), in S7 the controller 100 issues an error notification to the user by displaying an image on a display of the inkjet printer 1, outputting sounds, or the like, and in S8 halts operations of the components in the inkjet printer 1, thereby restricting the execution of printing operations on the inkjet printer 1. This error may occur due to a malfunction of the sensor 140, stopper 50, or valve 60 of the ink cartridge 40 or a malfunction of the hollow needle 153 or moving mechanism 155 of the inkjet printer 1.

When a plurality of ink cartridges 40 are simultaneously mounted in the inkjet printer 1, the controller 100 performs essentially the same series of processes described in FIG. 8 for each ink cartridge 40.

Next, a method of manufacturing the ink cartridge 40 of this embodiment will be described with reference to FIG. 9. The steps in the manufacturing method may be performed either by a manufacturing apparatus or an operator. In this embodiment, a manufacturing apparatus is used to perform all steps. The manufacturing apparatus includes an injector, a parts assembly unit, a controller, and a display.

Figure 9:
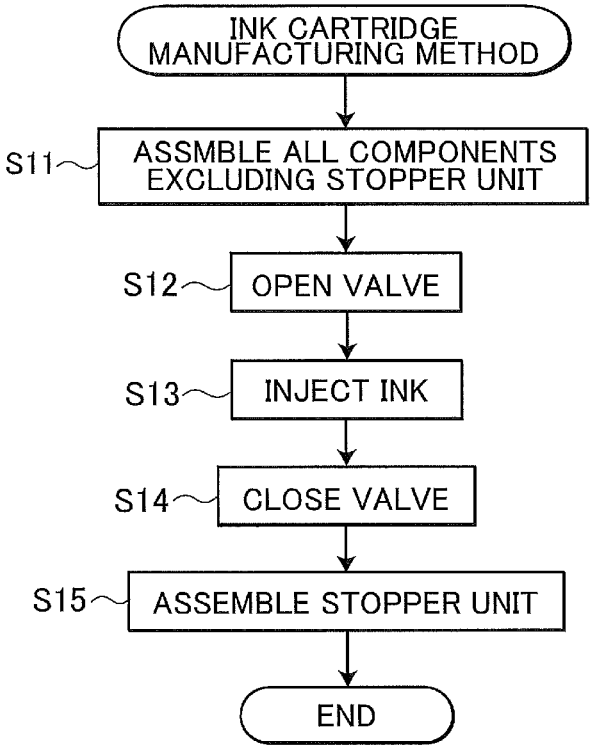
FIG. 9 is a flowchart illustrating steps in a method of manufacturing the ink cartridge according to the first embodiment of the present invention.

In S11 of FIG. 9 at the beginning of the manufacturing process, the controller of the manufacturing apparatus controls the parts assembly unit to assemble all components constituting the ink cartridge 40 (including the case 41, reservoir 42, tube 44, valve 60, sensor 140, memory unit 141, and contact 142), excluding the stopper unit (a unit including the stopper 50, cap 46, and cover 45). The parts assembly unit assembles the reservoir 42, tube 44, valve 60, sensor 140, and the like inside the case 41. These assembled parts including the case 41, reservoir 42, tube 44, valve 60, sensor 140, memory unit 141, and contact 142 correspond to a semimanufactured ink cartridge. In this manner, a semimanufactured ink cartridge is prepared. At this time, the flag stored in the memory unit 141 is set to ON.

In S12 the controller switches the valve 60 from the closed state to the open state by inserting an injection needle (a pressing rod) of the injector into the main part 44*a* through the opening 44*c* formed on the flange 44*b* end and pushing the valve body 62 with the injection needle against the urging force of the coil spring 63. With the stopper unit removed from the opening 44*c* in the end of the main part 44*a* and the valve 60 maintained in the open state achieved in S12, in S13 the controller controls the injector to inject ink through the open end of the main part 44*a* into the reservoir 42.

After the reservoir 42 has been filled in S13, in S14 the controller extracts the injection needle of the injector from the end of the main part 44*a*. As the injection needle is extracted, the urging force of the coil spring 63 returns the valve 60 from its open state to its closed state.

In S15 the controller drives the parts assembly unit to assemble the stopper unit on the tube 44 (the outlet path 43*a*). After the assembly is completed in S15, the opening 44*c* in the end of the main part 44*a* is closed up by the stopper unit and the stopper 50 is in a compressed state inside the protruding part 45*b*. This completes the manufacturing process for the ink cartridge 40.

Next, a method of recycling an ink cartridge 40 will be described with reference to FIG. 10. The method of recycling the ink cartridge 40 corresponds to a method of manufacturing a recycled ink cartridge. Each step of the recycling method described below may be performed either by a recycling apparatus or an operator. A recycling apparatus is used in this embodiment to perform all steps of the recycling process. The recycling apparatus includes an injector, a suction pump, a parts removal and replacement unit, a controller, and a display.

Figure 10:
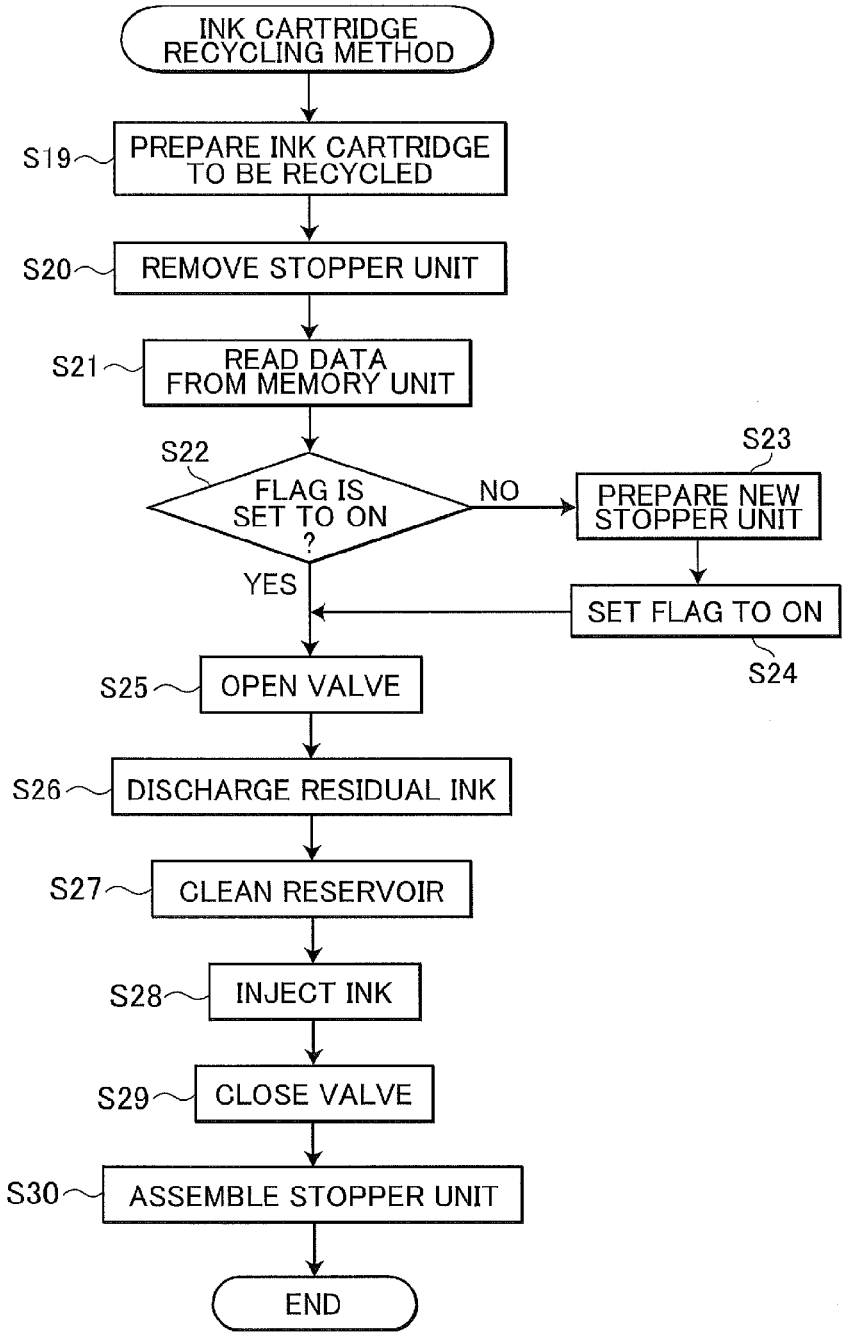
FIG. 10 is a flowchart illustrating steps in a method of recycling the ink cartridge according to the first embodiment of the present invention.

In S19 at the beginning of the recycled process in FIG. 10, an ink cartridge 40 to be recycled is prepared. The ink cartridge 40 to be recycled is not limited to a used ink cartridge 40 but may be an unused ink cartridge 40. In S20 the controller of the recycling apparatus drives the parts removal and replacement unit to remove the stopper unit from the opening 44*c* in the main part 44*a* for one ink cartridge 40 being recycled. In other words, the stopper unit is removed from the outlet path 43*a*.

In S21 the controller reads the flag data from the memory unit 141 of the ink cartridge 40. In S22 the controller determines whether the flag is set to ON.

When the flag is set to OFF (S22: NO), in S23 the controller drives the parts removal and replacement unit to prepare a new stopper unit in order to replace the stopper unit removed in S20 with the new stopper unit. In S24 the controller sets the flag in the memory unit 141 to ON and advances to S25 described below. However, if the flag is set to ON (S22: YES), the controller advances directly to S25 while the parts removal and replacement unit holds the stopper unit removed in S20.

In S25 the controller switches the valve 60 from its closed state to its open state, as in S12 of the manufacturing process. In S26 the controller generates a suction power to the injection needle by the suction pump to discharge a residual ink that remains in the reservoir 42. In S27 the controller injects a cleaning liquid into the reservoir 42 from the injection needle and vibrates the reservoir 42 including the cleaning liquid at ultrasonic frequency. After the cleaning operation has been finished, the cleaning liquid is discharged by the suction power of the suction pump by way of the injection needle. Subsequently, in S28 the controller injects ink into the reservoir 42, as described in S13 of the manufacturing process. In S29 the controller returns the valve 60 to its closed state, as in S14 of the manufacturing process. Note that, when the flag is set to ON (S22: YES), the ink cartridge 40 has not been used and mounted on the inkjet printer 1. However, if a long period of time has elapsed after the ink cartridge 40 was manufactured, the ink stored in the ink cartridge 40 may have deteriorated. Therefore, even if the ink cartridge 40 has not been used and mounted on the inkjet printer 1, the ink in the ink cartridge 40 needs to be changed. Discharging the residual ink that may have deteriorated can improve quality of ink in the ink cartridge 40.

In S30 the controller drives the parts removal and replacement unit to attach the stopper unit on the tube 44. In other words, in S30 the stopper unit is attached to the outlet path 43*a* to block the opening 44*c* The stopper unit attached to the tube 44 at this time is the stopper unit removed in S20 when the flag was set to ON (i.e., when the process of S23 was not performed) or a new stopper unit when the flag was set to OFF (i.e., when the old stopper unit was replaced with a new stopper unit in S23). The stopper unit mounted on the tube 44 in S30 blocks the opening 44*c* in the end of the main part 44*a*. At this time, the stopper 50 is in a compressed state within the protruding part 45*b*. This step completes the process for recycling the ink cartridge 40.

When the ink cartridge 40 recycled according to the method described above is mounted in the inkjet printer 1, the controller 100 of the inkjet printer 1 performs the same process described in FIG. 8 for a new ink cartridge 40.

As described above, the ink cartridge 40 according to this embodiment has the detachable stopper 50, and the valve 60 that can open and close. When manufacturing or recycling the ink cartridge 40, the valve closing step for closing the valve (S14, S29) is performed after the ink injection step for filling the cartridge with ink (S13, S28). Closing the valve prevents ink from leaking out of the reservoir 42 after the ink injection step (S13, S28). Further, a penetration hole is not formed in the stopper 50 during the ink injection step since the ink injection step is performed while the stopper 50 is removed. Hence, this method mitigates the problem of ink leaking into the inkjet printer 1.

The ink cartridge 40 is provided with the memory unit 141 for storing the flag. During recycling, the controller of the recycling apparatus reads the flag data stored in the memory unit 141 (S21), determines whether the hollow needle 153 has been inserted through the stopper 50 based on the state of the flag (ON or OFF; S22), and in S30 reuses the stopper 50 if the hollow needle 153 has not been inserted therethrough. Accordingly, this method can reduce recycling costs.

The valve 60 is urged toward the closed state by the coil spring 63. Hence, the valve closing step (S14, S29) can be easily implemented without any special mechanism or control process.

Next, a second embodiment of an ink cartridge 240 and a method of recycling the same according to the present invention will be described with reference to FIGS. 11 through 14.

The ink cartridge 240 according to the second embodiment differs from the ink cartridge 40 described in the first embodiment in the structure of a cover 245 and a stopper 250, as well as the omission of the cap 46 and memory unit 141 (or the omission of the flag stored in the memory unit 141 in the first embodiment). The cover 245 and the stopper are served as a stopper unit in the second embodiment. The remaining structure of the ink cartridge 240 is identical to that of the ink cartridge 40 according to the first embodiment. The following description will focus on the differences from the ink cartridge 40 according to the first embodiment, and like parts and components are designated with the same reference numerals to avoid duplicating description.

Figure 11A:
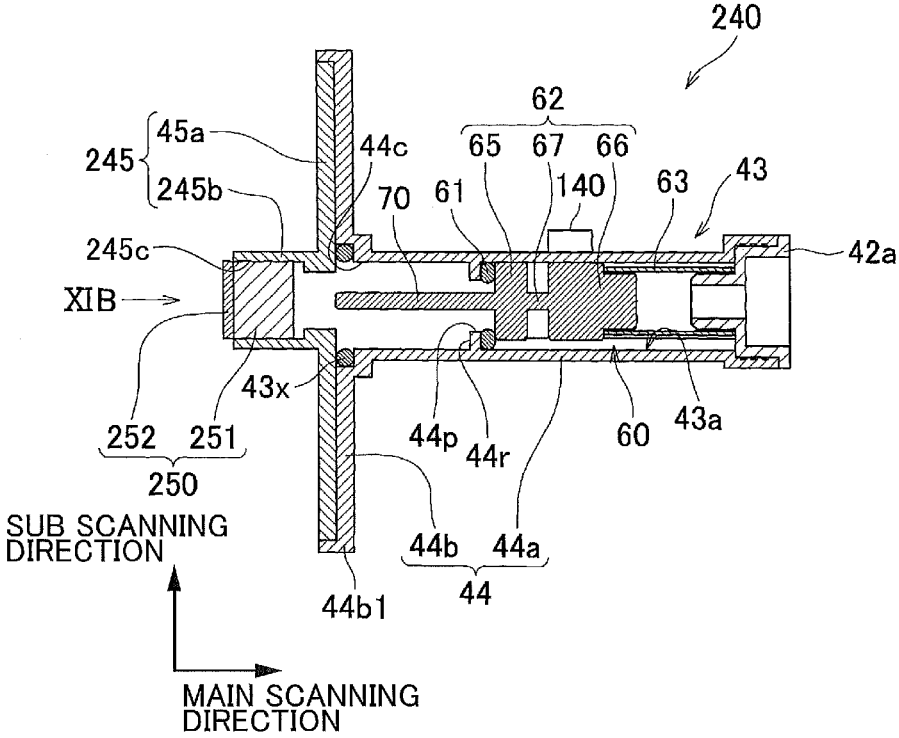
FIG. 11(*a*) is a partial cross-sectional view of the ink cartridge according to a second embodiment when the valve is opened.
Figure 11B:
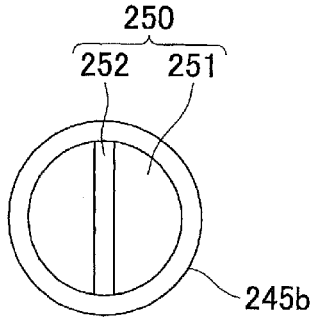

As shown in FIG. 11(*a*), the cover 245 includes the disc-shaped part 45*a* and a protruding part 245*b*. Like the protruding part 45*b* in the first embodiment, the protruding part 245*b* extends in the main scanning direction. However, unlike the protruding part 45*b*, the distal end of the protruding part 245*b* does not have an expanded diameter.

The stopper 250 includes a rubber material 251 that is substantially columnar in shape, and a conductor 252 provided on the distal endface of the rubber material 251.

The rubber material 251 is formed of an elastic material and is provided in an opening 245*c* of the protruding part 245*b* on the distal end thereof (the end opposite the disc-shaped part 45*a*). The rubber material 251 is in a compressed state for blocking the opening 245*c*. The distal endface of the rubber material 251 is substantially flush with the distal edge of the protruding part 245*b* with respect to the main scanning direction.

As shown in FIG. 11, the conductor 252 is a thin film having a narrow rectangular shape. The conductor 252 is bonded to the distal endface of the rubber material 251.

Figure 12A:
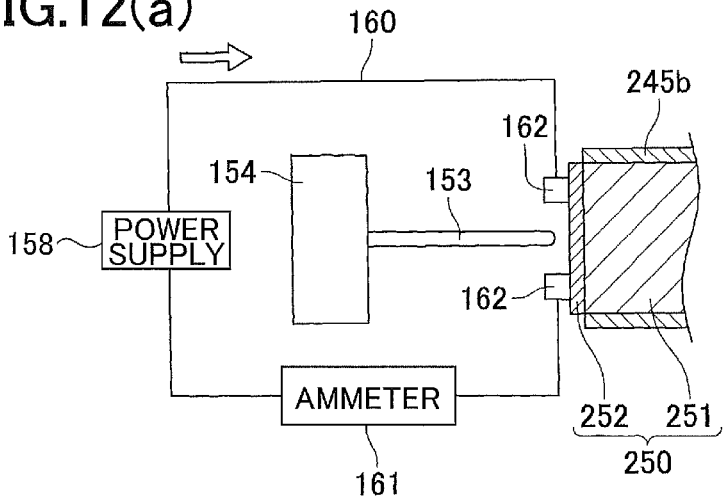
FIGS. 12(*a*) and 12(*b*) are explanatory diagrams showing a process of mounting the ink cartridge according to the second embodiment on the inkjet printer.
Figure 12B:
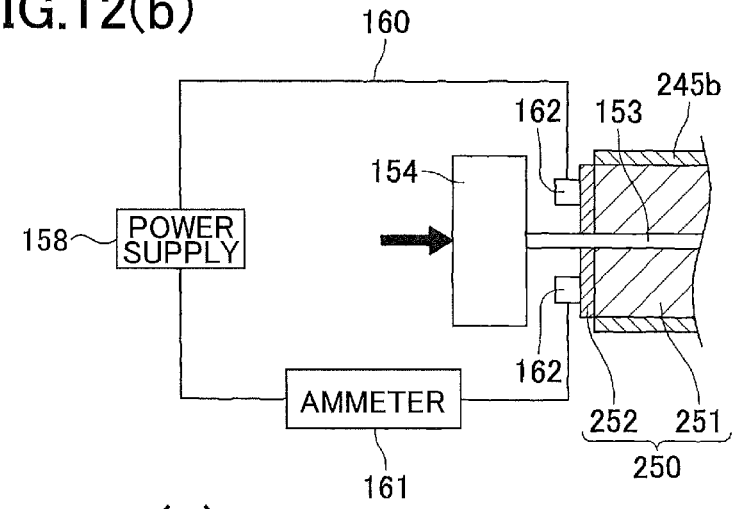
Figure 12C:
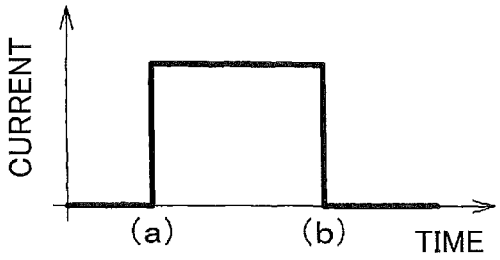
Figure 13:
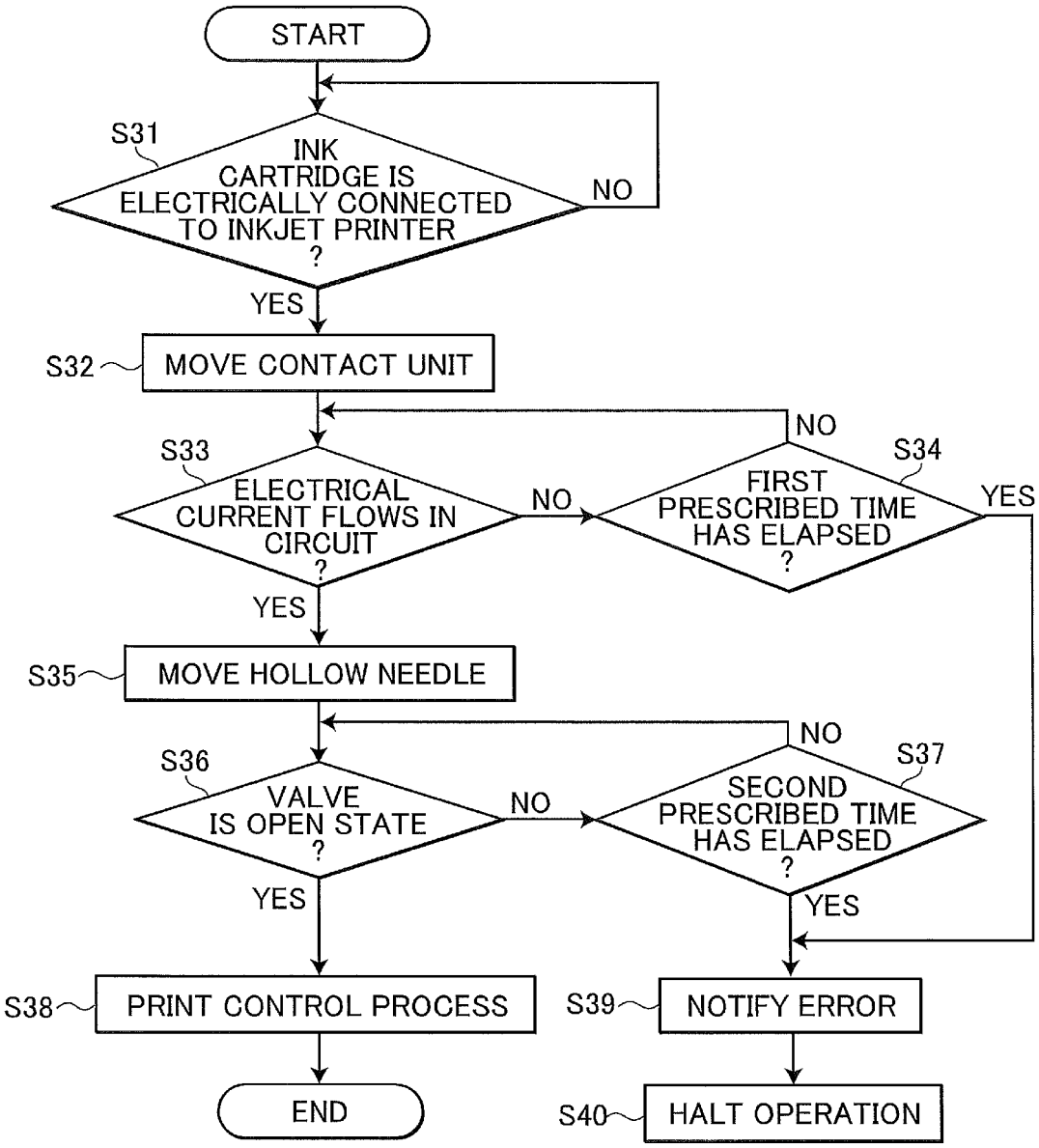
FIG. 13 is a flowchart illustrating steps in a control process performed by the controller in the inkjet printer according to the second embodiment when the ink cartridge is mounted in the inkjet printer.

In addition to the components constituting the inkjet printer 1 described in the first embodiment, the printer in which the ink cartridge 240 according to the second embodiment is detachably mounted includes a circuit 160, a pair of contacts 162 for contacting the conductor 252, a movable contact unit (not shown) on which the contacts 162 are formed, and an ammeter 161, as shown in FIG. 12. The contact unit is provided in the casing 1*a* at a position opposing the conductor 252 of the ink cartridge 240. The contacts 162 are formed apart from each other on the surface of the contact unit.

As in the first embodiment, first the contact 142 and contact 152 form respective electrical connections with the power input unit 147 and power output unit 157 as the ink cartridge 240 is mounted in the printer, as shown in FIG. 6(*a*). Thus, in S31 of the flowchart in FIG. 13, the controller 100 detects an electrical connection between the ink cartridge 240 and the printer at this time (S31: YES). On the other hand, the controller 100 does not detect the electrical connection (S31: NO), the controller 100 continually repeats the determination in S31.

In S32 the controller 100 begins to move the contact unit in the main scanning direction indicated by a white arrow in FIG. 12(*a*). After initiating movement of the contact unit in S32, in S33 the controller 100 determines whether an electrical current from the power supply 158 flows in the circuit 160, based on the electric current value acquired from the ammeter 161. As shown in FIG. 12(*a*), the electrical current flows in the circuit 160 when the pair of contacts 162 contacts the conductor 252 and form an electrical connection with each other via the conductor 252.

During this operation, the current value measured by the ammeter 161 fluctuates as shown in FIG. 12(*c*). In the graph of FIG. 12(*c*), (a) indicates the electric current measured when the printer and the ink cartridge 240 are in the state shown in FIG. 12(*a*), while (b) indicates the electric current measured when the hollow needle 153 ruptures the conductor 252. The controller 100 determines in S33 that the electrical current flows in the circuit 160, as shown in FIG. 12(*a*), when the value of the electric current rises.

However, while the controller 100 determines in S33 that the electrical current does not flow in the circuit 160 (the circuit 160 has not been formed) (S33: NO), the controller 100 continually repeats this determination in S33 while also determining in S34 whether a first prescribed time has elapsed after the controller 100 begins to move the contact unit. If the first prescribed time elapses before the electrical current flows in the circuit 160 (S34: YES), in S39 the controller 100 issues an error notification and in S40 halts operations of the printer, as described in S7 and S8 of the first embodiment.

Once the electrical current has flowed in the circuit 160 (S33: YES), in S35 the controller 100 controls the moving mechanism 155 (see FIG. 7) to begin moving the support body 154 and the hollow needle 153 supported by the support body 154 in the main scanning direction indicated by the black arrow in FIG. 12(*b*), as described in S2 of the first embodiment. After initiating the operation to move the hollow needle 153 in S35, in S36 the controller 100 determines whether the valve 60 has switched to its open state, based on the value outputted from the sensor 140, as described in S3 of the first embodiment.

As shown in FIG. 12(*a*), the hollow needle 153 in the second embodiment is positioned inside the contact unit until the controller 100 begins moving the hollow needle 153 in S35. At this time, the distal end of the hollow needle 153 is positioned farther inside than the contacts 162 (farther from the ink cartridge 240).

As the moving mechanism 155 begins moving the hollow needle 153 in S35, as illustrated in FIG. 12(*b*), the hollow needle 153 begins to protrude farther out from the contact unit than the contacts 162 and is inserted into the stopper 250. During this movement, the hollow needle 153 sequentially penetrates the conductor 252 and rubber material 251, rupturing the conductor 252 into two pieces on opposite sides of the hollow needle 153 from each other. Consequently, the circuit 160 is interrupted and the hollow needle 153 is constructed of insulating material, and the current value measured by the ammeter 161 returns to zero, as shown in FIG. 12(*c*).

When the controller 100 determines in S36 that the valve 60 has switched to the open state (S36: YES), in S38 the controller 100 begins the same print control process described in S5, and subsequently ends the current routine. However, while the controller 100 determines in S36 that the valve 60 has not shifted to the open state (S36: NO), the controller 100 continually repeats the determination in S36 while also determining in S37 whether a second prescribed time has elapsed after the moving mechanism 155 begins moving the hollow needle 153. If the second prescribed time elapses before the valve 60 is shifted to the open state (S37: YES), in S39 the controller 100 issues an error notification, and in S40 halts operations of the printer, as described in the first embodiment.

Figure 14:
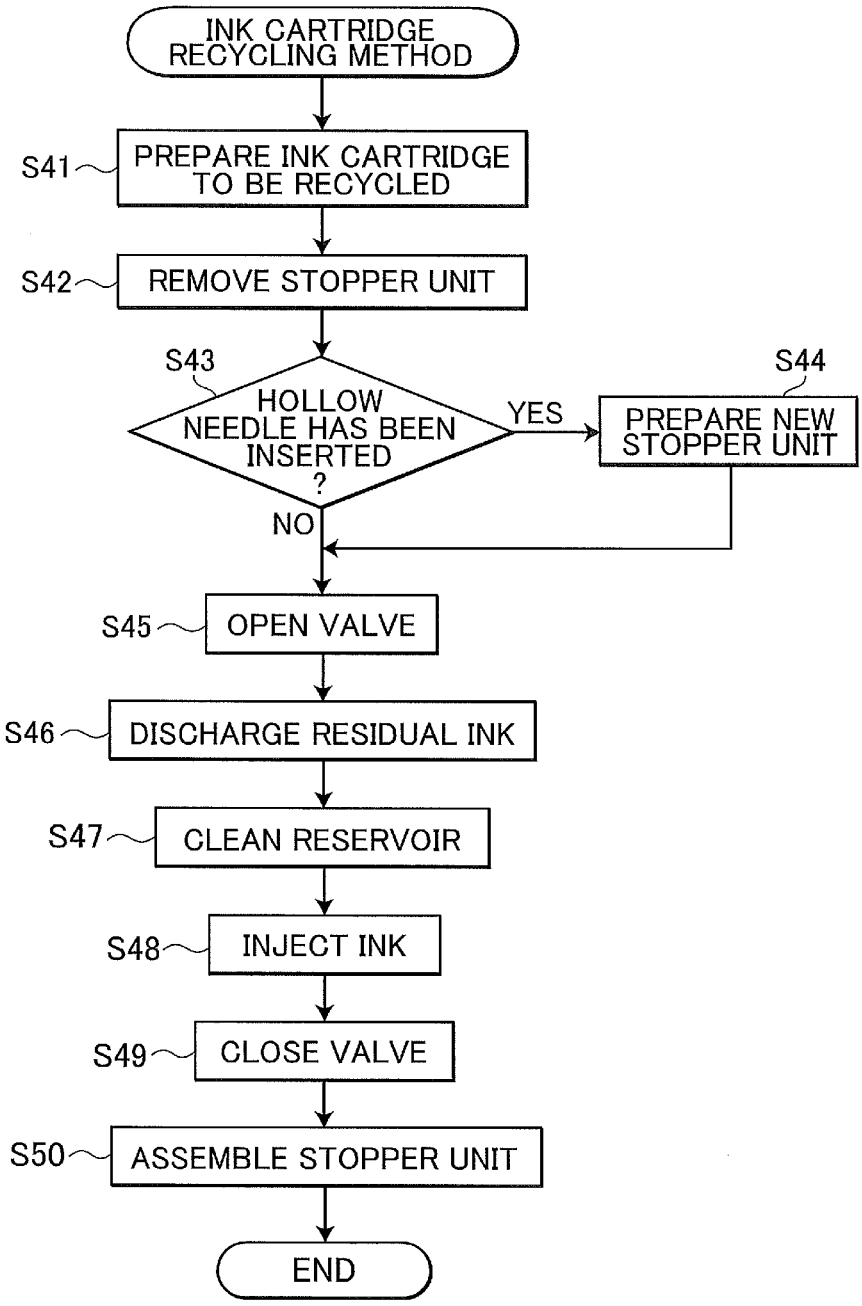
FIG. 14 is a flowchart illustrating steps in a method of recycling the ink cartridge according to the second embodiment of the present invention.

Next, a method of recycling the ink cartridge 240 according to the second embodiment will be described with reference to FIG. 14.

The recycling method according to the second embodiment differs from that in the first embodiment (see FIG. 10) by the omission of step S21 for acquiring flag data and step S24 for setting the flag to ON after replacing the stopper unit, and by determining whether the hollow needle 153 has been inserted through the stopper 250 based on the state of the conductor 252 (S43) instead of determining whether the flag is set to ON, as in S22 of the first embodiment. The remaining steps in the recycling method according to the second embodiment are identical to those in the first embodiment (i.e., steps S41, S42, S44, S45, S46, S47, S48, S49, and S50 in FIG. 14 are equivalent to steps S19, S20, S23 S25, S26, S27, S28, S29, and S30 in FIG. 10). Below the differences from the first embodiment will be described.

In S43 the controller of the recycling apparatus determines whether the hollow needle 153 has been inserted through the stopper 250 based on the existence of a circuit formed through the conductor 252. This determination is made using components similar to the contacts 162, circuit 160, and ammeter 161 (see FIG. 12(*a*)) of the printer, for example. Since the conductor 252 would be broken if the hollow needle 153 has formed an insertion hole in the stopper 250, the measured electric current value would not rise when the pair of contacts 162 was placed in contact with the contact 152, as shown FIG. 12(*a*). In this case, the controller of the recycling apparatus determines that the hollow needle 153 has previously been inserted through the stopper 250 (S43: YES), in S44 prepares a new stopper unit to replace the stopper unit removed in S42 with the new stopper unit, and subsequently advances to S45.

However, if the hollow needle 153 has not formed an insertion hole in the stopper 250, the measured electric current would rise as shown in FIG. 12(*c*) when the contacts 162 contact the contact 152 as shown in FIG. 12(*a*). In this case, the controller of the recycling apparatus determines that the hollow needle 153 has not been previously inserted through the stopper 250 and, hence, that an insertion hole has not been formed in the stopper 250 (S43: NO) and advances directly to S45.

In S50 at the end of the recycling process, the stopper unit removed in S42 is reattached to the tube 44 when the process of S44 was not performed (i.e., when the controller determined that the hollow needle 153 was not inserted through the stopper 250), while a new stopper unit is attached to the tube 44 when the new stopper unit is prepared in S44 (i.e., when the controller 100 determined that the hollow needle 153 had been inserted through the stopper 250).

As described above, the ink cartridge 240 according to this embodiment has the detachable stopper 250 and the valve 60 that can be opened and closed. When recycling the ink cartridge 240, the valve closing step (S49) is performed after the ink injection step (S48). Hence, as with the method according to the first embodiment, the recycling method according to the second embodiment can prevent ink from leaking from the reservoir 42.

In the second embodiment, the stopper 250 has the conductor 252 that is ruptured by the hollow needle 153 when the hollow needle 153 is inserted through the stopper 250. When recycling the ink cartridge 240, a controller determines whether the hollow needle 153 has been inserted through the stopper 250 based on the state of the conductor 252 (S43) and in S50 reuses the stopper 50 if the hollow needle 153 has not been inserted therethrough, thereby reducing recycling costs.

By configuring a rupturable part of the stopper 250 with the conductor 252, the state of this part can be confirmed electrically in S43.

The conductor 252 configures part of the circuit 160 provided in the printer (see FIG. 12(*a*)) prior to the hollow needle 153 being inserted through the stopper 250. Accordingly, the state of the conductor 252 can be confirmed in S43 before the hollow needle 153 is inserted into the stopper 250.

While the invention has been described in detail with reference to specific embodiments thereof, it would be apparent to those skilled in the art that many modifications and variations may be made therein without departing from the spirit of the invention, the scope of which is defined by the attached claims.

The structure of the cartridge according to the present invention may be modified in a variety of ways. For example, it is possible to suitably modify the configuration (shape, position, and the like) of the reservoir 42, case 41, outlet path 43*a*, stopper 50 (250), valve 60, sensor 140, and the like. It is also possible to add new components and to eliminate some of the components described in the embodiments described above.

The number of valves incorporated in the ink cartridge 40 or 240 is also arbitrary. Further, the valve may be configured by combining a stopper, a spherical body, and a coil spring. For example, the stopper may include a slit that penetrates the center of the stopper in the main scanning direction, and a curved part on the inner surface (surface opposing the valve 60) for accommodating the spherical body. The coil spring urges the spherical body against the stopper so that the spherical body seals the slit formed in the stopper when a hollow member (hollow needle 153) has not been inserted through the stopper. When the hollow member is inserted through the slit in the stopper, the distal end of the hollow member contacts the spherical body and moves this spherical body against the urging force of the coil spring, breaking the seal formed by the spherical body and switching the valve from its closed state to its open state. Subsequently, the spherical body contacts the distal end of the pressing member 70, switching the valve 60 from its closed state to its open state.

The sensor 140 is not limited to a reflective-type photosensor, as described in the above embodiments, but may be another type of sensor, such as transmissive photosensor, a magnetic sensor, or a sensor with a mechanical switch for detecting the presence of an object through contact.

It is also possible to employ a configuration that does not urge the valve into its closed state. In this case, it is necessary to drive a mechanism for switching the valve from its open state to its closed state, and the methods of manufacturing and recycling the cartridge should include a step for closing the valve.

The type of liquid stored in the ink cartridge 40 or 240 is not limited to ink, but may be a liquid used to coat the printing medium prior to printing in order to enhance image quality, a cleaning liquid for cleaning the conveying belt, or the like.

The data stored in the memory unit 140 of the ink cartridge 40 for indicating whether the hollow needle 153 has been inserted through the stopper 50 is not limited to a flag described in the first embodiment that is based on the results of detecting whether the stopper 50 is open or closed, but may be data based on the results of directly detecting whether the hollow needle 153 has been inserted through the stopper 50 (using a sensor provided in the hollow needle 153, for example). In other words, the data indicating whether the hollow needle 153 has been inserted through the stopper 50 may be data inferring that the hollow needle 153 has been inserted or data indicating with certainty that the hollow needle 153 has been inserted.

When the rupturable part is the conductor 252, the conductor 252 needs not constitute part of the circuit provided in the inkjet printer 1. Further, the position of the conductor 252 on the stopper 50 may be modified. For example, the conductor 252 of the second embodiment (see FIG. 11) may be provided on the inner endface of the rubber material 251 (the surface opposing the pressing member 70).

The rupturable part is also not limited to the conductor 252, but may be formed of an elastic material such as rubber, similar to the stopper 50 in the first embodiment. In this case, the operator recycling the ink cartridge 240 may confirm the state of the rupturable part by sight in order to determine whether the hollow needle 153 has been inserted through the stopper 50.

Another variation to the recycling method of the above embodiments involves omitting the determination step in S22 or S43 and mounting a new stopper 50 (new stopper unit) in S30 or S50, rather than reusing the existing stopper 50 (existing stopper unit), even when the hollow needle 153 was not previously inserted through the existing stopper 50. Further, the processes of S21-S24 and S43-S44 may be performed any time before the process of S30 and S50 is performed.

The steps in the cartridge manufacturing and recycling processes (the steps for removing and attaching a stopper unit and for injecting liquid, for example) may be performed manually by an operator. In this case, the manufacturing apparatus or recycling apparatus should possess a display.

In the embodiments described above, a stopper unit including the stopper 50, cap 46, and cover 45 or the stopper 250 and cover 245, rather than just the stopper 50, 250, is mounted in or removed from the liquid outlet (opening 44*c* in the main part 44*a* on the flange 44*b* end) in S15, S20, S30, S42, and S50 and is replaced in S23 and S44. However, the same steps may be modified to mount only the stopper 5, 250 in or remove only the stopper 50, 250 from the liquid outlet (the opening 45*c* or 245*c*) and to replace only the stopper 50, 250 instead of the stopper unit, For example, the stopper 50, 250 in the embodiments described above may be mounted in and removed from the opening 45*c* or 245*c* formed in the distal end of the protruding part 45*b* or 245*c*.

The hollow needle 153 may be inserted into the outlet path 43*a* based on control by the controller 100 in the inkjet printer 1, as described in the above embodiments, or through a manual operation by the user of the inkjet printer 1. In the latter case, the inkjet printer 1 does not include the moving mechanism 155 (see FIG. 7).

When the user mounts an ink cartridge in the inkjet printer 1, the hollow needle 153 may enter the outlet path 43*a* at substantially the same time that electrical connections are formed between the contact 142 and contact 152 and the power input unit 147 and power output unit 157.

The timing at which the ink cartridge 40 and the inkjet printer 1 are enabled to exchange signals and the timing at which the inkjet printer 1 is capable of supplying power to the ink cartridge 40 may be arbitrarily modified and are not limited to the timings described in the above embodiments. In addition, the positions of the contacts 142 and 152, power input unit 147, power output unit 157, and the like on the ink cartridge 40 and the inkjet printer 1 may be arbitrarily modified.

The ink cartridge 40 is not limited to a cartridge mounted in a printer, but may be an ink cartridge mounted in a facsimile machine, a copy machine, or other liquid-ejecting device. Further, the inkjet head 2 of the inkjet printer 1 may be a serial type head rather than a line-type head. The number of inkjet heads 2 incorporated in the inkjet printer 1 is not limited to four, provided that there is at least one.

What is claimed is:

1. A method of manufacturing a recycled liquid cartridge, the method comprising:

(a) preparing a liquid cartridge to be recycled, the liquid cartridge comprising a liquid storing unit configured to store liquid therein, a liquid delivery path that is in fluid communication with the liquid storing unit and is configured to supply liquid externally from the liquid storing unit, the liquid delivery path having an opening, a blocking member detachably mounted in the liquid delivery path to block the opening, and a valve configured to be switched between an open state in which the liquid delivery path is opened and a closed state in which the liquid delivery path is closed, the valve being positioned between the opening and the liquid storing unit;

(b) removing the blocking member from the liquid delivery path;

(c) switching the valve from the closed state to the open state;

(d) injecting liquid into the liquid storing unit through the opening with the blocking member removed in step (b) and the valve maintained in the open state achieved in step (c);

(e) switching the valve from the open state to the closed state after performing step (d); and (f) assembling the blocking member or another blocking member different from the blocking member in the liquid delivery path to block the opening after performing step (e).

2. The method according to claim 1, wherein each of the blocking member and the another blocking member comprises a resilient member that is detachably mounted in the liquid delivery path in a compressed state.

3. The method according to claim 1, further comprising:

(g) discharging a residual liquid that remains in the liquid storing unit after performing step (c) and before performing step (d); and (h) cleaning the liquid storing unit after performing step (g) and before performing step (d).

4. The method according to claim 1, wherein the liquid cartridge to be recycled is detachably mountable on a liquid ejection device comprising a liquid ejecting part that ejects the liquid supplied from the liquid cartridge and a hollow member that is configured to be inserted through the blocking member for supplying the liquid from the liquid cartridge to the liquid ejecting part, and the liquid cartridge comprises a storage unit that is configured to store data indicating whether the hollow member has been inserted through the blocking member, and the method further comprising:

(i) reading the data stored in the storage unit; and (j) determining whether or not the hollow member has been inserted through the blocking member based on the data read in step (i), and wherein, if it is determined that the hollow member has not been inserted through the blocking member, the blocking member removed in step (b) is assembled in the liquid delivery path in step (f).

5. The method according to claim 1, wherein the liquid cartridge to be recycled is detachably mountable on a liquid ejection device comprising a liquid ejecting part that ejects the liquid supplied from the liquid cartridge and a hollow member that is configured to be inserted through the blocking member for supplying the liquid from the liquid cartridge to the liquid ejecting part, and the blocking member comprises a rupturable part that is configured to be ruptured by the hollow member when the hollow member is inserted through the blocking member, and the method further comprising:

(k) determining whether or not the hollow member has been inserted through the blocking member by detecting whether or not the rupturable part is ruptured, wherein, if it is determined that the hollow member has not been inserted through the blocking member, the blocking member removed in step (b) is assembled in the liquid delivery path in step (f).

6. The method according to claim 1, wherein the cartridge further includes an urging member that is configured to urge the valve into the closed state.

7. A method of manufacturing a liquid cartridge, the method comprising:

(a) preparing a semimanufactured liquid cartridge, the semimanufactured liquid cartridge comprising a liquid storing unit configured to store liquid therein, a liquid delivery path that is in fluid communication with the liquid storing unit and is configured to supply liquid externally from the liquid storing unit, the liquid delivery path having an opening, and a valve configured to be switched between an open state in which the liquid delivery path is opened and a closed state in which the liquid delivery path is closed, the valve being positioned between the opening and the liquid storing unit;

(b) switching the valve from the closed state to the open state;

(c) injecting liquid into the liquid storing unit through the opening with the valve maintained in the open state achieved in step (b);

(d) switching the valve from the open state to the closed state after performing step (c); and (e) assembling a blocking member in the liquid delivery path to block the opening after performing step (d) in such a manner that the blocking member is detachable from the liquid delivery path.

8. A liquid cartridge comprising:

a liquid storing unit that is configured to store liquid therein;

a liquid delivery path that is in fluid communication with the liquid storing unit and is configured to supply liquid externally from the liquid storing unit, the liquid delivery path having an opening;

a blocking member that is detachably mounted in the liquid delivery path to block the opening, the blocking member comprising a resilient member that is detachably mountable in the liquid delivery path in a compressed state; and a valve configured to be capable of being switched between an open state in which the liquid delivery path is opened and a closed state in which the liquid delivery path is closed, the valve being positioned between the opening and the liquid storing unit, wherein the liquid cartridge is detachably mountable on a liquid ejection device comprising a liquid ejecting part that ejects the liquid supplied from the liquid cartridge and a hollow member that is configured to be inserted through the blocking member for supplying the liquid from the liquid cartridge to the liquid ejecting part, wherein the blocking member comprises a rupturable part that is configured to be ruptured by the hollow member when the hollow member is inserted through the blocking member, wherein the rupturable part comprises a conductor, and wherein the liquid ejection device comprises a circuit, the conductor configuring part of the circuit when the liquid cartridge is mounted on the liquid ejection device and the conductor is not ruptured.

9. The liquid cartridge according to claim 8, further comprising an urging member configured to urge the valve into the closed state.

* * * * *